US010292446B2

(12) United States Patent
Jinkins

(10) Patent No.: US 10,292,446 B2
(45) Date of Patent: May 21, 2019

(54) WHIPLASH REDUCTION SYSTEMS AND DEVICES AND METHODS TO USE THE SAME

(71) Applicant: Larry E. Jinkins, Plainfield, IN (US)

(72) Inventor: Larry E. Jinkins, Plainfield, IN (US)

(73) Assignee: Larry E. Jinkins, Plainfield, IN (US)

( * ) Notice: Subject to any disclaimer, the term of this patent is extended or adjusted under 35 U.S.C. 154(b) by 208 days.

(21) Appl. No.: 15/257,608

(22) Filed: Sep. 6, 2016

(65) Prior Publication Data

US 2016/0366967 A1 Dec. 22, 2016

Related U.S. Application Data

(63) Continuation-in-part of application No. 14/538,452, filed on Nov. 11, 2014.

(60) Provisional application No. 62/214,247, filed on Sep. 4, 2015, provisional application No. 62/017,041, filed on Jun. 25, 2014, provisional application No. 61/902,709, filed on Nov. 11, 2013.

(51) Int. Cl.

| | |
|---|---|
| ***A42B 3/00*** | (2006.01) |
| ***A42B 3/04*** | (2006.01) |
| ***A41D 13/05*** | (2006.01) |
| ***A63B 71/10*** | (2006.01) |

(52) U.S. Cl.

CPC ..... *A42B 3/0473* (2013.01); *A41D 13/0512* (2013.01); *A63B 71/10* (2013.01); *A63B 2243/007* (2013.01)

(58) Field of Classification Search

CPC .. A42B 3/0473; A41D 13/0512; A63B 71/10; A63B 2243/007

See application file for complete search history.

(56) References Cited

U.S. PATENT DOCUMENTS

| | | | | | |
|---|---|---|---|---|---|
| 3,818,509 | A * | 6/1974 | Romo | A42B 3/0473 | 2/421 |
| 5,437,613 | A * | 8/1995 | Reggio | A42B 3/0473 | 2/425 |
| 6,009,566 | A * | 1/2000 | Hubbard | A41D 13/0512 | 2/421 |
| 2004/0055077 | A1* | 3/2004 | Wright | A42B 3/0473 | 2/421 |
| 2005/0204457 | A1* | 9/2005 | Stiles | A41D 13/0512 | 2/425 |
| 2006/0026808 | A1* | 2/2006 | Downing | A41D 13/0512 | 24/628 |

(Continued)

*Primary Examiner* — Khaled Annis

(74) *Attorney, Agent, or Firm* — Reichel Stohry LLP; Mark C. Reichel; Natalie J. Dean

(57) ABSTRACT

Whiplash reduction systems and devices and methods to use the same. In an embodiment of a system of the present disclosure, the system comprises a front anchor strap coupled directly or indirectly to a headgear; a top anchor coupled to the front anchor strap, the top anchor having a connector coupled thereto, the connector configured to connect to at least one rear strap; a first retainer configured to fit within apertures defined within the headgear and to wrap around at least part of the headgear and at least part of the front anchor strap to secure the front anchor strap to the headgear at or near the apertures; and a plate having a central portion defining a recessed portion and further having a first side portion and a second side portion.

18 Claims, 41 Drawing Sheets

(56) References Cited

U.S. PATENT DOCUMENTS

| | | | | |
|---|---|---|---|---|
| 2008/0313791 | A1* | 12/2008 | Nagely | A42B 3/0473 2/425 |
| 2010/0229287 | A1* | 9/2010 | Mothaffar | A41D 13/0512 2/421 |
| 2011/0060260 | A1* | 3/2011 | Siegler | A42B 3/0473 602/18 |
| 2014/0020163 | A1* | 1/2014 | Stiles | A42B 3/0473 2/468 |
| 2014/0090156 | A1* | 4/2014 | Tom | A42B 3/0473 2/421 |
| 2014/0283287 | A1* | 9/2014 | Pocatko | A42B 3/0473 2/421 |

* cited by examiner

WHIPLASH REDUCTION SYSTEMS AND DEVICES AND METHODS TO USE THE SAME

PRIORITY

The present application a) is related to, and claims the priority benefit of, U.S. Provisional Patent Application Ser. No. 62/214,247, filed Sep. 4, 2015, and b) is related to, claims the priority benefit of, and is a U.S. continuation-in-part patent application of, U.S. Nonprovisional patent application Ser. No. 14/538,452, filed Nov. 11, 2014, which is related to, and claims the priority benefit of, U.S. Provisional Patent Application Ser. No. 62/017,041, filed Jun. 25, 2014, and U.S. Provisional Patent Application Ser. No. 61/902,709, filed Nov. 11, 2013. The contents of each of these applications are hereby incorporated by reference in their entirety into the present disclosure.

BACKGROUND

Several injuries, ranging from minor to fatal, occur each year by children and adults engaging in physical athletic activity, such as football, or other sports where the player's head and spine may be compromised due to various impacts.

Devices, systems, kits, and methods of using the same, configured to reduce, or even eliminate, the risk of whiplash and reduction of whiplash (so to protect the head and neck and potentially result in fewer or less severe concussions), head injury, and/or cervical injury, would be well received in the marketplace.

BRIEF SUMMARY

In an exemplary embodiment of a system of the present disclosure, the system comprises one or more of the following:

(a) a shoulder apparatus configured to fit atop a person's shoulders; and/or (b) a shoulder flange operably coupled to, or defined as part of, a shoulder apparatus; and/or (c) a flange cushion configured to fit upon, or otherwise coupled to, a shoulder flange, the flange cushion optionally defining an opening to receive at least part of the shoulder flange, and also optionally comprising a back portion as described herein; and/or (d) one or more flange pads within, or as part of, a flange cushion; and/or (e) a headgear, such as a helmet, optionally defining a headgear aperture therein and/or comprising a headgear element, the headgear aperture configured to receive and/or the headgear element configured to couple to one or more tensile straps and/or one or more attachment elements; and/or (f) one or more tensile straps configured to couple to a headgear and to also couple to one or more of a flange cushion and a shoulder flange, the one or more tensile straps comprising one or more types of stretchable/elastic material; and/or (g) one or more attachment elements coupled to one or more tensile straps, the one or more attachment elements configured to facilitate coupling of the one or more tensile straps to a headgear, a shoulder flange, and/or a flange cushion; and/or (h) one or more shoulder cushions positioned upon, or comprising part of, a shoulder apparatus; and/or (i) one or more shoulder straps coupled to a shoulder apparatus.

(j) one or more shoulder straps coupled to a shoulder apparatus; and/or (k) a plate configured to received straps therethrough; and/or (l) a first side cushion, a second side cushion, and/or a central cushion; and/or (m) a clasp and an optional clasp strap, connected to a plate; and/or (n) an adapter.

In an exemplary embodiment of a kit of the present disclosure, the kit comprises one or more of the components referenced above.

In various exemplary embodiments of devices, systems, and/or kits of the present disclosure, the devices, systems, and/or kits are configured to reduce concussions, instances and/or severity of whiplash, head injury, and/or cervical injury.

In an exemplary embodiment of a method for reducing concussions, head injury, and/or cervical injury of the present disclosure, the method includes the step of using a device, system, and/or kit of the present disclosure while engaging in athletic activity.

In an exemplary embodiment of a system or kit of the present disclosure, the system or kit comprises a) a shoulder flange, the shoulder flange defined as part of a shoulder apparatus configured to fit atop a person's shoulders or configured to couple to the shoulder apparatus, b) a flange cushion configured to fit upon, or otherwise coupled to, the shoulder flange, the flange cushion comprising one or more flange pads, and c) one or more tensile straps configured to couple to a headgear and to also couple to one or more of the flange cushion and/or the shoulder flange. In another embodiment, the system or kit further comprises the shoulder apparatus. In yet another embodiment, the system or kit further comprises one or more shoulder cushions positioned upon, or comprising part of, the shoulder apparatus. In an additional embodiment, the system or kit further comprises one or more shoulder straps coupled to the shoulder apparatus.

In an exemplary embodiment of a system or kit of the present disclosure, the flange cushion defines an opening to receive at least part of the shoulder flange. In an additional embodiment, the flange cushion comprises a back portion. In yet an additional embodiment, the system or kit further comprises a headgear, such as a helmet. In another embodiment, the system or kit further comprises one or more attachment elements coupled to the one or more tensile straps, the one or more attachment elements configured to facilitate coupling of the one or more tensile straps to a headgear, the shoulder flange, and/or the flange cushion.

In an exemplary embodiment of a system or kit of the present disclosure, the headgear defines a headgear aperture therein, the headgear aperture configured to receive the one or more tensile straps and/or the one or more attachment elements. In another embodiment, the headgear comprises a headgear element, the headgear element configured to couple to the one or more tensile straps and/or one or more attachment elements. In yet another embodiment, the one or more tensile straps comprising one or more types of stretchable/elastic material.

In an exemplary embodiment of a kit of the present disclosure, the kit comprises one or more flange cushions and one or more tensile straps.

In an exemplary embodiment of a system or kit of the present disclosure, the system or kit comprises a plate as described and/or shown herein, having one or more pads/cushions coupled thereto and configured for placement upon a shoulder apparatus, and one or more tensile straps configured to couple to a headgear and to also couple to the plate. In another embodiment, the system or kit further comprises the shoulder apparatus. In yet another embodiment, the system or kit further comprises a headgear, such as a helmet.

In an exemplary embodiment of a system of the present disclosure, the system comprises a shoulder flange configured for coupling to, or defined as part of, a shoulder apparatus, a flange cushion configured to fit upon or otherwise couple to the shoulder flange, and one or more tensile straps configured to couple to at least one of the shoulder flange and the flange cushion, the one or more tensile straps further configured to couple to a headgear. In another embodiment, the one or more tensile straps comprise one or more types of stretchable/elastic material. In yet another embodiment, the flange cushion defines an opening therein to receive at least part of the shoulder flange. In an additional embodiment, the flange cushion comprises one or more flange pads.

In an exemplary embodiment of a system of the present disclosure, the system further comprises the headgear, defining a headgear aperture therein configured to receive the one or more tensile straps or an attachment element coupled to the one or more tensile straps. In an additional embodiment, the system further comprises the headgear, comprising a headgear element configured to couple to the one or more tensile straps or an attachment element coupled to the one or more tensile straps. In yet an additional embodiment, the one or more tensile straps have one or more attachment elements coupled thereto.

In an exemplary embodiment of a system of the present disclosure, the system further comprises the shoulder apparatus. In another embodiment, the shoulder apparatus has one or more shoulder cushions positioned thereon. In yet another embodiment, the shoulder apparatus has one or more shoulder straps coupled thereto. In an additional embodiment, the shoulder apparatus further comprises a plate configured to receive the one or more shoulder straps therethrough.

In an exemplary embodiment of a system of the present disclosure, the shoulder flange has a first aperture and a second aperture defined therein, the first aperture configured to receive a first shoulder flange strap therethrough and the second aperture configured to receive a second shoulder flange strap therethrough. In an additional embodiment, the shoulder flange is configured as a plate having a central portion, a first side portion having a first aperture defined therethrough, and a second side portion having a second aperture defined therethrough. In yet an additional embodiment, the flange cushion comprises a first side cushion, a second side cushion, and a central cushion.

In an exemplary embodiment of a system of the present disclosure, the system further comprises a clasp coupled to a clasp strap, the clasp strap coupled to the shoulder flange. In another embodiment, the system is configured so that when the headgear, shoulder flange, and shoulder apparatus are worn by a person, the one or more tensile straps prevent the headgear from moving to an extent permitted if the one or more tensile straps was/were not present.

In an exemplary embodiment of a system of the present disclosure, the system comprises a shoulder flange configured for coupling to, or defined as part of, a shoulder apparatus, the shoulder flange having a first aperture and a second aperture defined therein, the first aperture configured to receive a first shoulder flange strap therethrough and the second aperture configured to receive a second shoulder flange strap therethrough, a flange cushion configured to fit upon or otherwise couple to the shoulder flange, the flange cushion comprising one or more flange pads, and one or more tensile straps configured to couple to at least one of the shoulder flange and the flange cushion, the one or more tensile straps further configured to couple to a headgear.

In an exemplary embodiment of a kit of the present disclosure, the kit comprises a shoulder flange configured for coupling to, or defined as part of, a shoulder apparatus, a flange cushion configured to fit upon or otherwise couple to the shoulder flange, and a plurality of tensile straps configured to couple to at least one of the shoulder flange and the flange cushion, the plurality of tensile straps further configured to couple to a headgear. In another embodiment, the kit further comprises the shoulder apparatus. In yet another embodiment, the kit further comprises the headgear, such as a helmet.

In an exemplary embodiment of a system of the present disclosure, the system comprises a front anchor strap coupled directly or indirectly to a headgear; a top anchor coupled to the front anchor strap, the top anchor having a connector coupled thereto, the connector configured to connect to at least one rear strap; a first retainer configured to fit within apertures defined within the headgear and to wrap around at least part of the headgear and at least part of the front anchor strap to secure the front anchor strap to the headgear at or near the apertures; and a plate having a central portion defining a recessed portion and further having a first side portion and a second side portion.

In an exemplary embodiment of a system of the present disclosure, the front anchor strap is coupled directly to the headgear using one or more fasteners.

In an exemplary embodiment of a system of the present disclosure, the front anchor strap is coupled indirectly to the headgear by coupling the front anchor strap to a plate and coupling the plate to the headgear.

In an exemplary embodiment of a system of the present disclosure, the system further comprises a connector positioned upon or within the front anchor strap, the connector configured to couple the front anchor strap to the top anchor and to allow the top anchor to pivot relative to the connector.

In an exemplary embodiment of a system of the present disclosure, the system further comprises a strap cushion coupled to the front anchor strap.

In an exemplary embodiment of a system of the present disclosure, the system further comprises a second retainer configured to fit within additional apertures defined within the headgear and to wrap around at least part of the headgear and at least part of the front anchor strap to secure the front anchor strap to the headgear at or near the additional apertures.

In an exemplary embodiment of a system of the present disclosure, the system further comprises a support comprising a flexible material, the support configured to at least partially cover the central portion of the plate.

In an exemplary embodiment of a system of the present disclosure, the system further comprises a support cover configured to cover at least part of the support In an exemplary embodiment of a system of the present disclosure, the system further comprises a first cushion positioned within the recessed portion of the plate.

In an exemplary embodiment of a system of the present disclosure, the system further comprises a second cushion positioned adjacent to the first cushion, wherein the first cushion comprises an impact dampening material, and wherein the second cushion comprises foam or foam rubber.

In an exemplary embodiment of a system of the present disclosure, the at least one rear strap has a first tensile strength, and wherein the at least one rear strap further comprises at least one tensioner coupled thereto so to form a loop.

In an exemplary embodiment of a system of the present disclosure, the at least one tensioner has a second tensile strength, and whereby first pulling relative ends of the at least one rear strap away from one another causes portions of the at least one rear strap not forming the loop to be relatively straight, and whereby additional pulling the relative ends of the at least one rear strap away from one another causes portions of the at least one rear strap forming the loop to be relatively straight so to close the loop.

In an exemplary embodiment of a system of the present disclosure, when the headgear is worn by a person who is also wearing a shoulder apparatus, the system can be connected to the shoulder apparatus using a first shoulder strap and a second shoulder strap, the first and second shoulder straps configured to connect to the shoulder apparatus and to connect to the plate.

In an exemplary embodiment of a system of the present disclosure, the first shoulder strap and the second shoulder strap have a hook and loop fastener portion corresponding to hook and loop fastener portions of the shoulder apparatus and the plate, whereby the hook and loop fastener portions of the first shoulder strap and the second shoulder strap are configured to the hook and loop fastener portions of the shoulder apparatus and the plate.

In an exemplary embodiment of a system of the present disclosure, when the headgear is worn by a person who is also wearing a shoulder apparatus, the first cushion is positioned adjacent to a rear portion of the headgear.

In an exemplary embodiment of a system of the present disclosure, when the headgear is worn by a person who is also wearing a shoulder apparatus, the person can rotate his or her head relative to a pivot point located at or near a relative top of the headgear where the top anchor is coupled to the front anchor strap.

In an exemplary embodiment of a system of the present disclosure, when the headgear is worn by a person who is also wearing a shoulder apparatus and upon impact to the headgear, the at least one rear strap would slow movement of the headgear in a first direction, and a braking effect caused by the at least one rear strap would cause the headgear to move in an opposite second direction so to reduce and/or prevent whiplash.

In an exemplary embodiment of a system of the present disclosure, the system comprises a front anchor strap coupled directly or indirectly to a headgear; a top anchor coupled to the front anchor strap, the top anchor having a connector coupled thereto, the connector configured to connect to at least one rear strap; a first retainer configured to fit within apertures defined within the headgear and to wrap around at least part of the headgear and at least part of the front anchor strap to secure the front anchor strap to the headgear at or near the apertures; a plate having a central portion defining a recessed portion and further having a first side portion and a second side portion; a support comprising a flexible material, the support configured to at least partially cover the central portion of the plate; and a first cushion positioned within the recessed portion of the plate; wherein when the headgear is worn by a person who is also wearing a shoulder apparatus, the system can be connected to the shoulder apparatus using a first shoulder strap and a second shoulder strap, the first and second shoulder straps configured to connect to the shoulder apparatus and to connect to the plate.

In an exemplary embodiment of a system of the present disclosure, the system further comprises the headgear, wherein the headgear comprises a first piece and a second piece configured to be held together using one or more fasteners or anchors and further configured to be removed from the person wearing the headgear by disengaging the fasteners or anchors to separate the first piece from the second piece.

In an exemplary embodiment of a method of reducing and/or preventing instances of whiplash, the method comprises the step of wearing a system of the present disclosure.

BRIEF DESCRIPTION OF THE DRAWINGS

The disclosed embodiments and other features, advantages, and disclosures contained herein, and the matter of attaining them, will become apparent and the present disclosure will be better understood by reference to the following description of various exemplary embodiments of the present disclosure taken in conjunction with the accompanying drawings, wherein.

Figure 1:
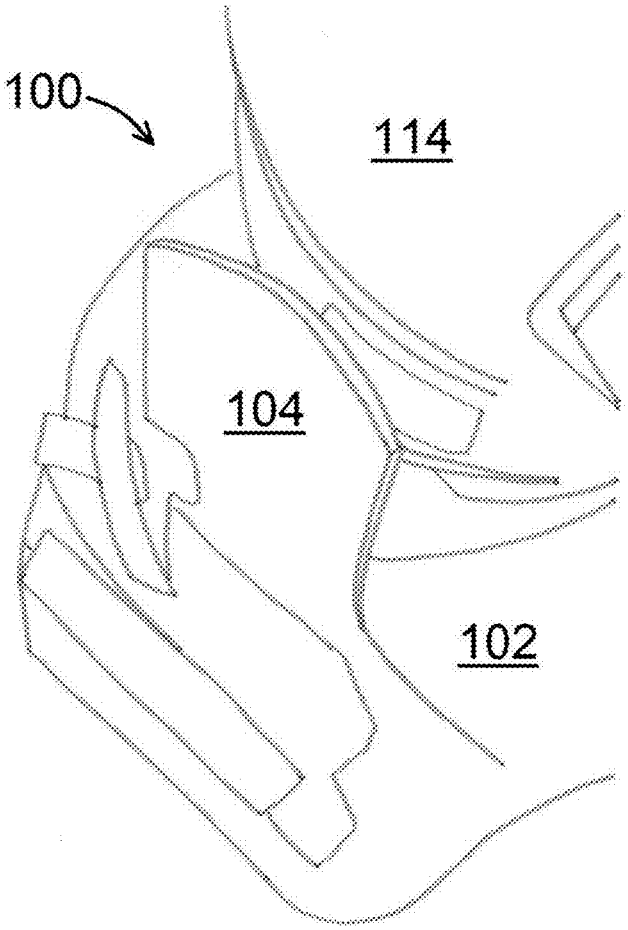
FIG. 1 shows a rear perspective view of components of a system, according to an exemplary embodiment of the present disclosure.

An overview of the features, functions and/or configurations of the components depicted in the various figures will now be presented. It should be appreciated that not all of the features of the components of the figures are necessarily described. Some of these non-discussed features, such as various couplers, etc., as well as discussed features are inherent from the figures themselves. Other non-discussed features may be inherent in component geometry and/or configuration.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

An exemplary system of the present disclosure is shown in FIG. 1. As shown in FIG. 1, which depicts a rear perspective view of certain elements of an exemplary system 100 of the present disclosure, system 100 comprises a shoulder apparatus 102 configured to fit atop a person's shoulders, such as one or more shoulder pads, a shoulder harness, or other device configured for placement atop the person's shoulders. Shoulder flange 104, as shown in FIG. 1, is either coupled to shoulder apparatus 102 or configured as part of shoulder apparatus 102, and is configured to be present vertically (either completely, substantially, or partially) relative to shoulder apparatus 102, which is configured to be present horizontally (either completely, substantially, or partially) relative to shoulder flange 104. In various embodiments, shoulder flange 104 is configured to be present behind a person's head when shoulder apparatus 102 is positioned upon the person's shoulders.

Figure 2:
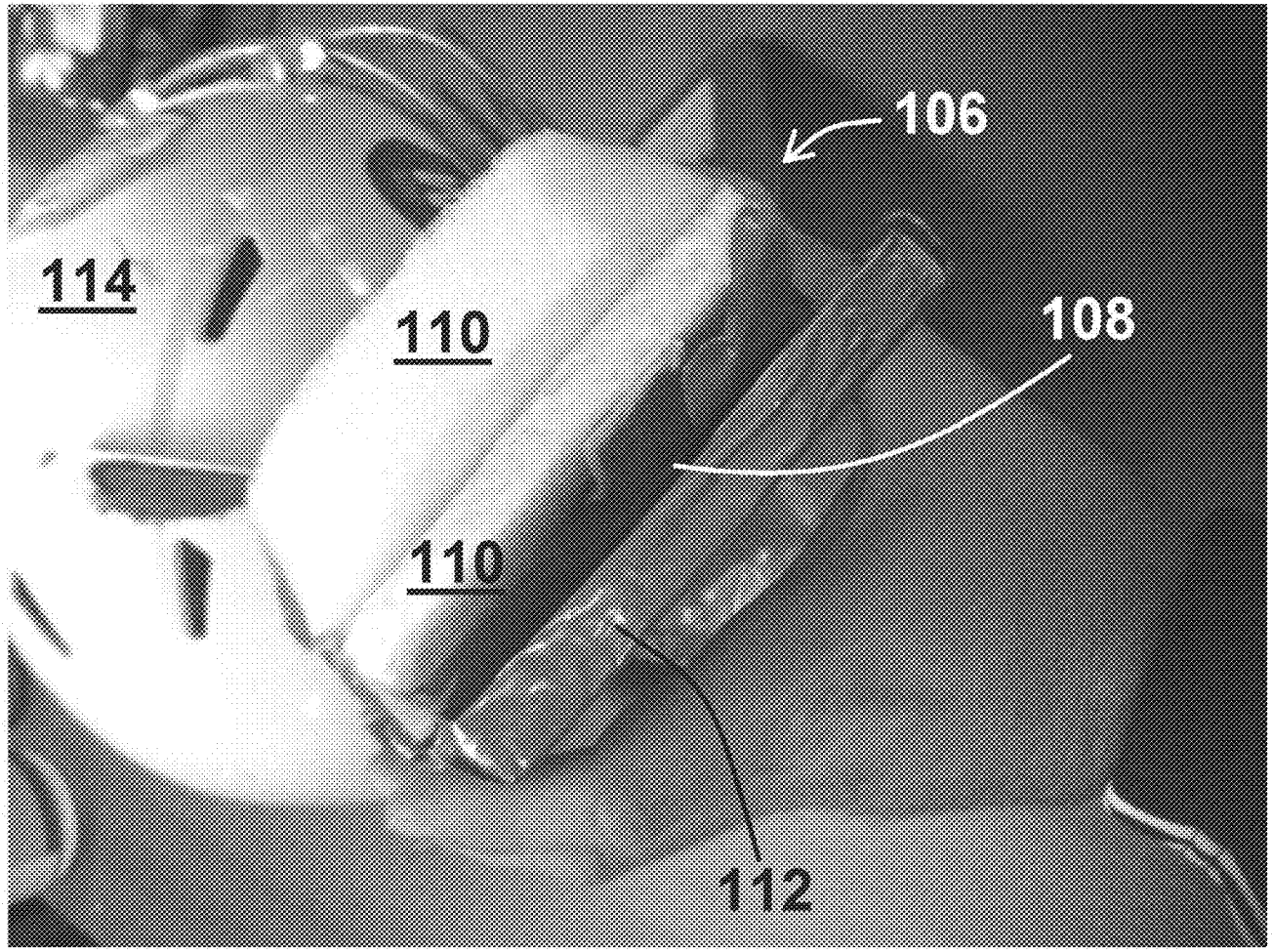
FIG. 2 shows a bottom view of a portion of a flange cushion, according to an exemplary embodiment of the present disclosure.
Figure 4:
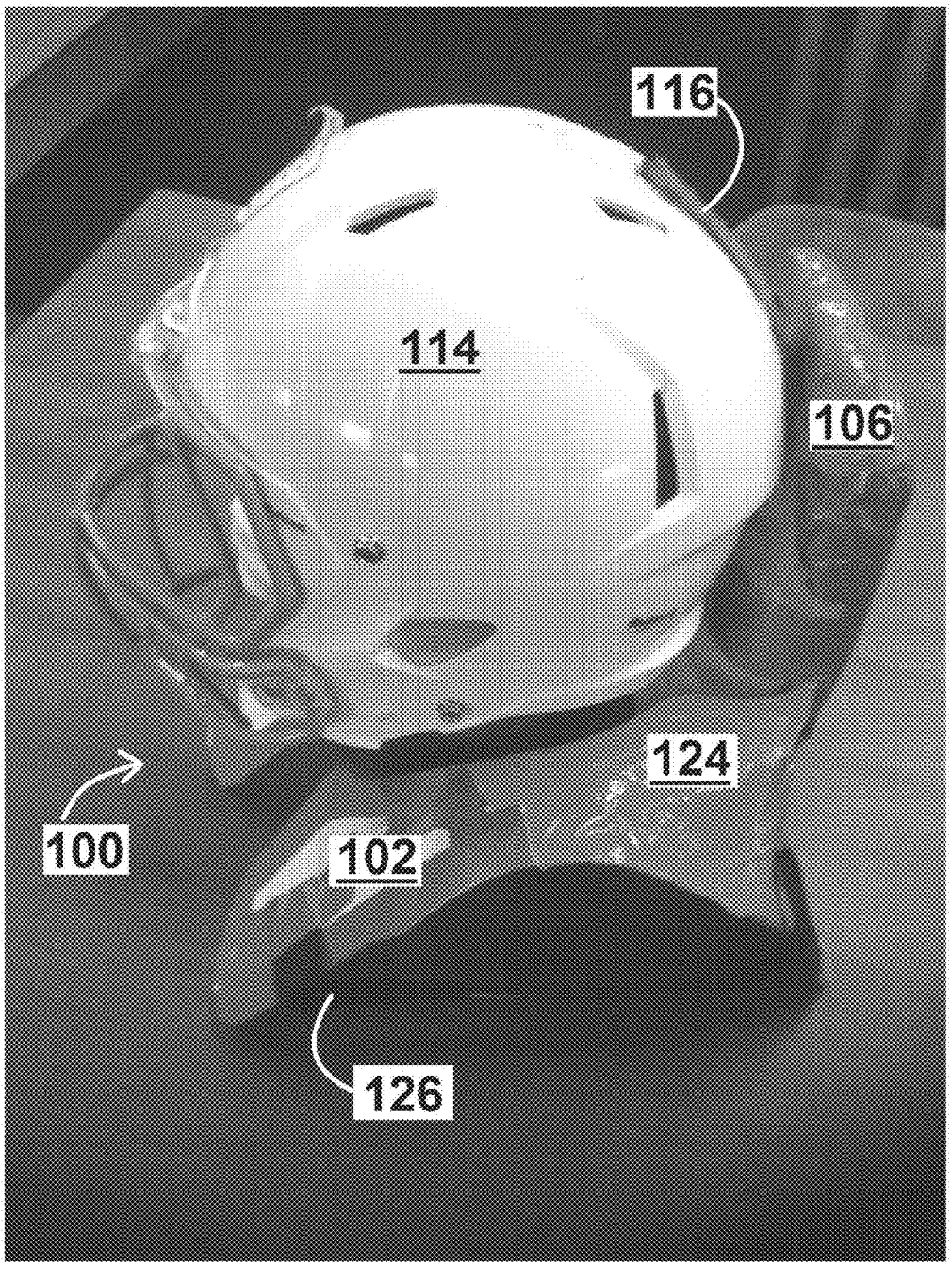

Various systems 100 of the present disclosure also comprise a flange cushion 106 configured to be coupled to shoulder flange 104, as shown in the bottom view of flange cushion 106 shown in FIG. 2. In various embodiments, flange cushion 106 is configured to couple directly to a relative side of shoulder flange 104, or as shown in FIG. 2, flange cushion 106 is configured for placement upon shoulder flange 104 by way of an opening 108 defined within flange cushion 106. Flange cushion 106 comprises at least one flange pad 110, wherein flange pad 110 is positioned relative to flange cushion 106 so that when portions of system 100 is worn by a person, flange pad 110 is positioned between shoulder flange 104 and the person's head. As shown in FIG. 4 for example, flange cushion 106 is configured to be slid upon shoulder flange 104, noting that such a configuration would eliminate or reduce the risk of flange cushion 106 from unintentionally uncoupling from shoulder flange 104 when in use. In such an embodiment, for example, flange cushion 106 comprises a back portion 112, whereby back portion 112, when flange cushion 106 is positioned upon shoulder flange 104, appears on a relative back portion of shoulder flange 104, opposite the location of flange pad(s) 110.

Figure 3:
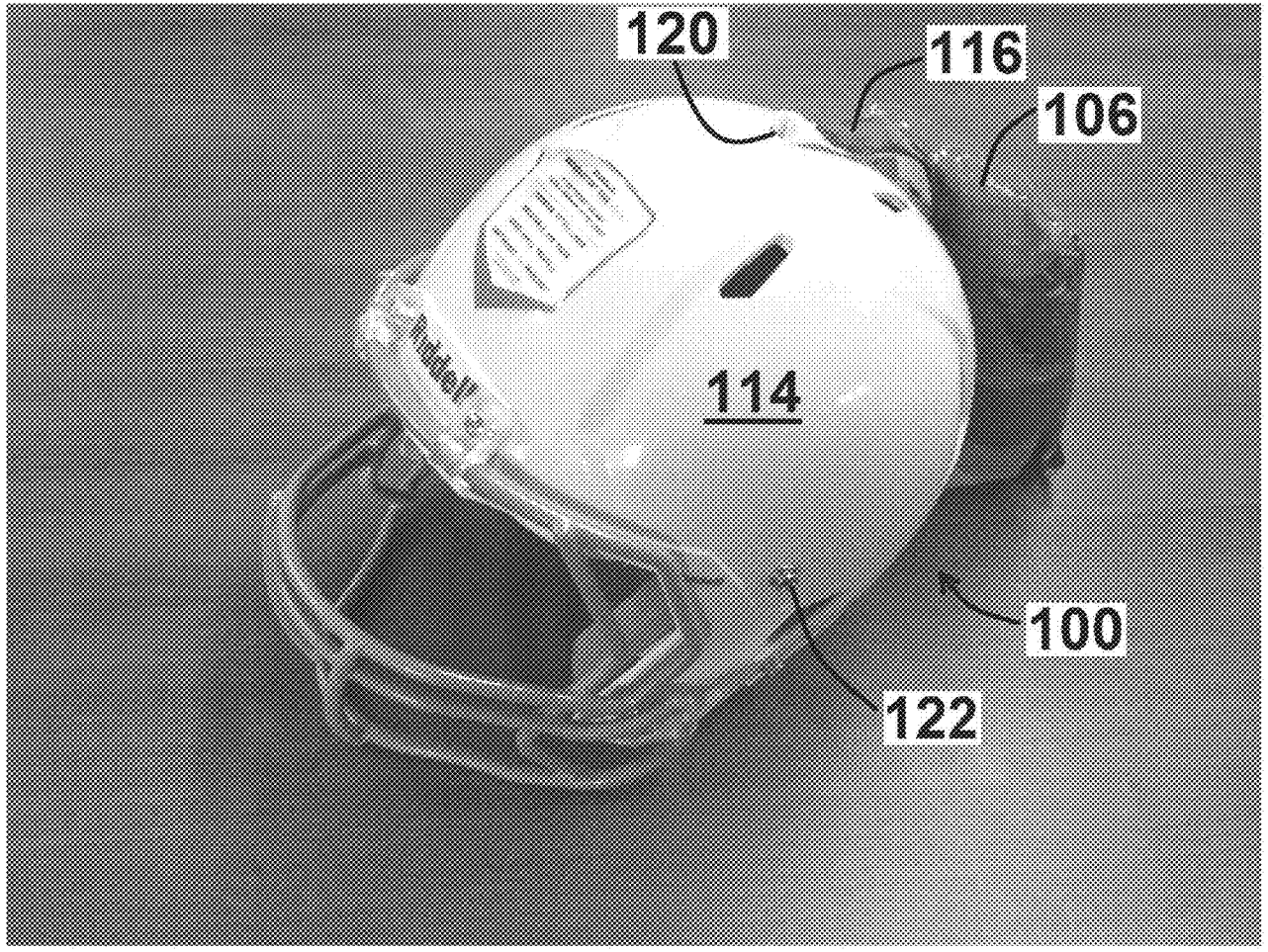
FIGS. 3 and 4 show side perspective views of components of a system, according to an exemplary embodiment of the present disclosure.

In various systems 100 of the present disclosure, systems 100 also comprise a headgear 114, such as a football helmet, hockey helmet, rugby helmet, racing helmet, another sport helmet, or a general helmet, such as shown in FIGS. 1-3 and other figures of the present disclosure. Various systems 100 also comprise at least one tensile strap 116, as shown in the perspective view of portions of an exemplary system 100 of the present disclosure, configured for attachment/coupling to flange cushion 106 and to headgear 114, as referenced herein. Tensile strap 116 may comprise a separate element that is attached/coupled to flange cushion 106, or may be formed as part of flange cushion 106. Tensile strap 116 is stretchable in its horizontal axis, and various straps 116 can be included in part of an exemplary kit 1000 (described in further detail below and shown in FIG. 10), so that the user can select from a potential plurality of straps 116 so that the desired strap 116 can be used. Tensile strap 116, in various other embodiments, may also be directly coupled to shoulder flange 104.

Figure 7:
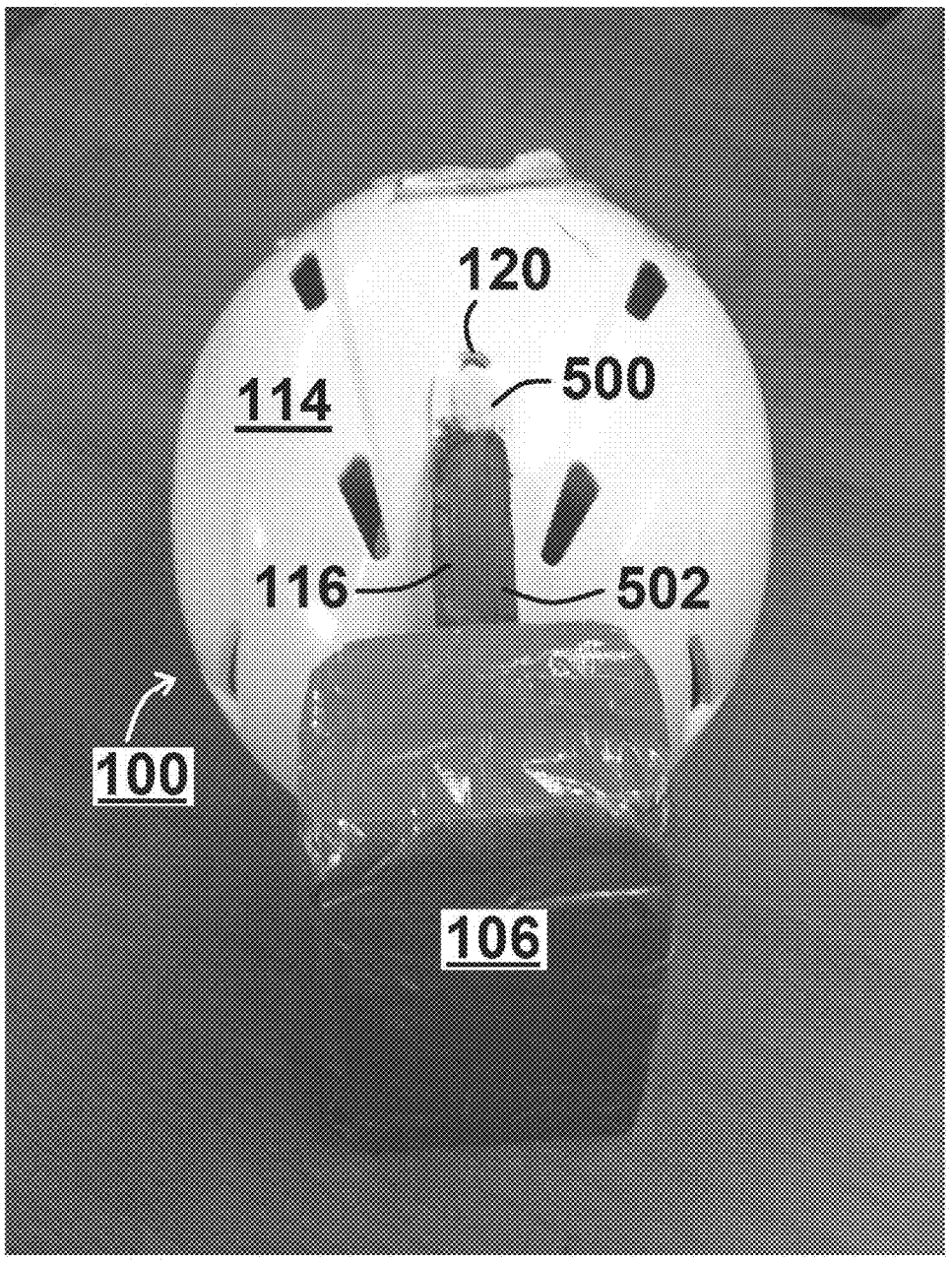
FIG. 7 shows a back view of components of a system, according to an exemplary embodiment of the present disclosure.

Tensile strap 116 is also configured for coupling to headgear 114, such as shown in FIG. 3. In various embodiments, strap 116 has an attachment element 118 (shown in FIGS. 5 and 8) coupled/attached thereto, whereby attachment element 118 is configured to attach to headgear 114. In various embodiment, attachment element 118 is configured to attach to a headgear aperture 120, as shown in FIG. 3 defined within headgear 116 and/or coupled to a headgear element 122, such as shown in FIG. 3, of headgear 116, such as a snap, flange, ring, hook, etc., that can be used to couple to attachment element 116 of strap 116. Tensile strap 116 may also be coupled to flange cushion using an attachment element 118, such as referenced above, or thread/other type of sewing material, as shown in FIG. 3. As shown in FIG. 7, for example, tensile strap 116 may be coupled to headgear 114 in a way to permit side to side movement/rotation of headgear, as attachment point 118 (shown in FIG. 8, for example) at headgear 114 is one point so to permit side to side movement, allowing the user of system 100 to move his or head as needed/desired to play a particular sport while also improving safety to that user.

As shown in FIG. 4, exemplary systems 100 of the present disclosure may comprise one or more shoulder cushions 124 positioned upon each relative side of shoulder apparatus 102. As shown in FIG. 4, shoulder cushion 124 is positioned upon shoulder apparatus 102 at or near a location of a person's shoulder when the person is wearing shoulder apparatus 102. Shoulder cushion 124, in various embodiments, is configured to provide a cushion to reduce impact of headgear 114 against shoulder apparatus 102, and/or is configured to prevent headgear 114 from moving in a direction toward a relative side of shoulder apparatus 102 as far as headgear 114 could otherwise move if no shoulder cushion 124 were present. One or more shoulder straps 126, as shown in FIG. 4, may also comprise part of an exemplary system 100 of the present disclosure, whereby shoulder straps 126 connect to two portions of shoulder apparatus 102 so that when a user is wearing shoulder apparatus 102, shoulder strap 126 would be positioned under the user's arm so to hold shoulder apparatus 102 in place.

As used in the National Football League (NFL) and other football leagues, such as college football, grade school football, etc., players are generally using the helmets (exemplary headgear 114) improperly on the field causing injury to self and to opponents. Helmets provide multiple layers of external protection, but do very little to provide "dynamic braking" (deceleration) or gradual slowing of the helmet. In view of the same, various systems 100 of the present disclosure, which can be viewed as concussion reduction systems or dynamic braking shoulder pad systems, for example, provide a gradual slowing of the helmet resulting from frontal or rear impacts, thus slowing the brain movement inside the skull resulting in fewer concussions. Contrary to popular belief, concussions occur from brain impact inside of the skull, and not from impact upon the outside of a player's head.

In addition to concussions, cervical injuries are increasing (particularly in youth sports) due to improper helmet use. Players rotating the head forward (chin to chest) are straightening the cervical spine creating a "bar-like" effect, thus putting the player in danger of serious injury. Players rotating the helmet forward are using the crown of the helmet (an exemplary headgear 114 of the present disclosure) as a weapon (like a battering ram), inflicting a significant impact on the opponent's chest, back and head.

In view of the foregoing, various systems 100 of the present disclosure are useful to reduce the occurrence of concussions and/or reduce the occurrence of cervical injuries that would otherwise occur with traditional football gear, for example.

The typical helmet's lack of dynamic braking and use as a weapon is creating the opportunity for serious injury to players' heads and cervical spines. Various shoulder cushions 124 of the present disclosure, in connection with various other elements of systems 100 referenced herein, create exemplary systems 100 that help the player wearing system 100 to maintain the helmet in the recommended tackling position (as noted in USA Football Heads Up), provide dynamic braking for the helmet (by way of tensile strap 116 coupled to headgear 114 and flange cushion 106), and reduce impact to the back of the helmet (by way of the aforementioned elements and/or elements of flange cushion 106, such as one or more flange pads 110 present behind the helmet. The results are fewer concussions and cervical spine injuries to players in sports using helmets and shoulder pads, and the various systems 100 of the present disclosure provide a solution to that ongoing and potentially devastating problem.

Various systems 100 of the present disclosure can be used with a number of sports, such as football, rugby, ice hockey, lacrosse, and others. Shoulder flanges 104, as referenced herein (also referred to generally as a "back plate" having properties/features as referenced herein), provide general headrest support with a dynamic force reduction strap (tensile strap 116) that is anchored to flange cushion 106 and headgear 114. Various layers of padding (flange pads 110) can be used, with each layer dissipating energy created by impact. Said flange pads 110 also provide a "dynamic braking" effect, as referenced herein in connection with tensile strap 116 and/or other elements of system 100, to gradually slow the helmet, thus reducing the speed of brain movement inside the skull. Shoulder flange 104 and flange cushion 106, as referenced herein, reduce impact to the back of the helmet created by a player or the ground by providing layers of protection between the helmet and contact point.

Tensile strap 116, as referenced herein, can serve a number of purposes. For example, and in various embodiments, tensile strap 116 can contain one type of material or multiple types of material (such as a first material 500 and a second material 502, shown in FIG. 5), to further produce a "dynamic braking" effect for impacts forcing the helmet to move forward. For example, a first material 500 may be relatively less elastic/stretchable than a second material 502, which would be relatively more elastic/stretchable, and the combination of the same may provide the desired braking effect and overall comfort for a particular use/sport. In addition, portions of tensile strap 116 may not be elastic/stretchable, while other portions of tensile strap 116 are elastic/stretchable. Various tensile straps 116 can be used depending on the desired use. Tensile straps 116 can also assist the player in maintaining the head in the optimal position for tackling or hitting by disrupting the player's ability to rotate the helmet in a forward motion (chin to chest). Limiting the player's ability to rotate the helmet in a forward position helps maintain the cervical integrity of the spine thus reducing the opportunity for cervical injury. In addition, limiting the degree of forward rotation of the helmet reduces the use of the top (crown) of the helmet as a weapon. The natural position of the head produces a forward weight which is exacerbated by the weight of the helmet, and tensile strap 116 will assist players in helmet stabilization.

Various elements of systems 100 of the present disclosure, such as shoulder flange 104 used with flange cushion 106, tensile strap 116 used in connection with flange cushion 106 and headgear 114, and others as referenced herein, provides new technologies shoulder apparatus 102 design, dynamic braking, dynamic force reduction, etc., currently not being utilized in the marketplace. For example, the combination of the headrest support with dynamic brake padding (flange cushion 106 and/or shoulder cushions 124) and the dynamic force reduction tensile strap 116 reduces the cause of concussions by reducing the speed of brain movement inside the skull as well as cervical injuries caused by "whiplash" regardless of impacts generated from the back or front.

Figure 5:
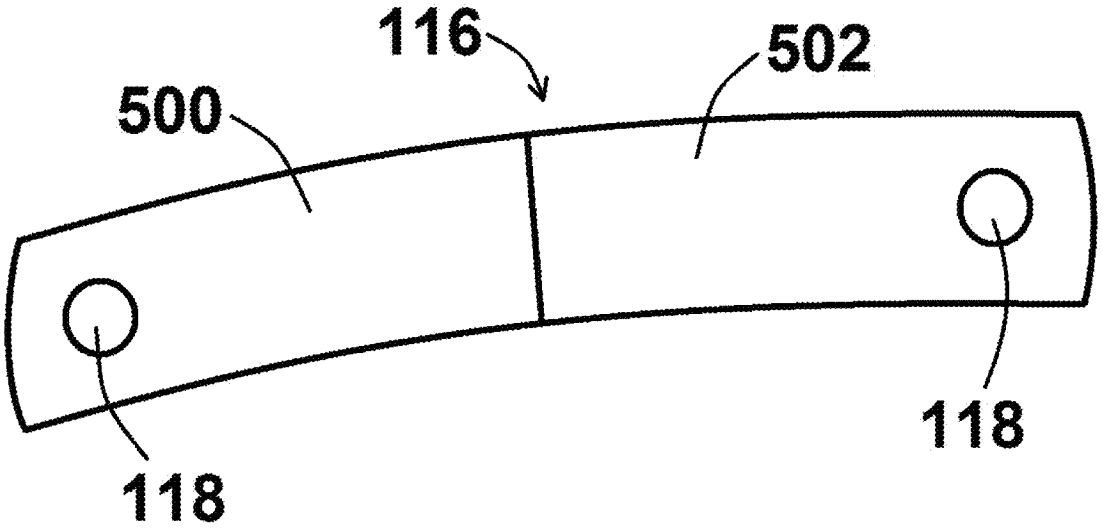
FIG. 5 shows a tension strap, according to an exemplary embodiment of the present disclosure.
Figure 6:
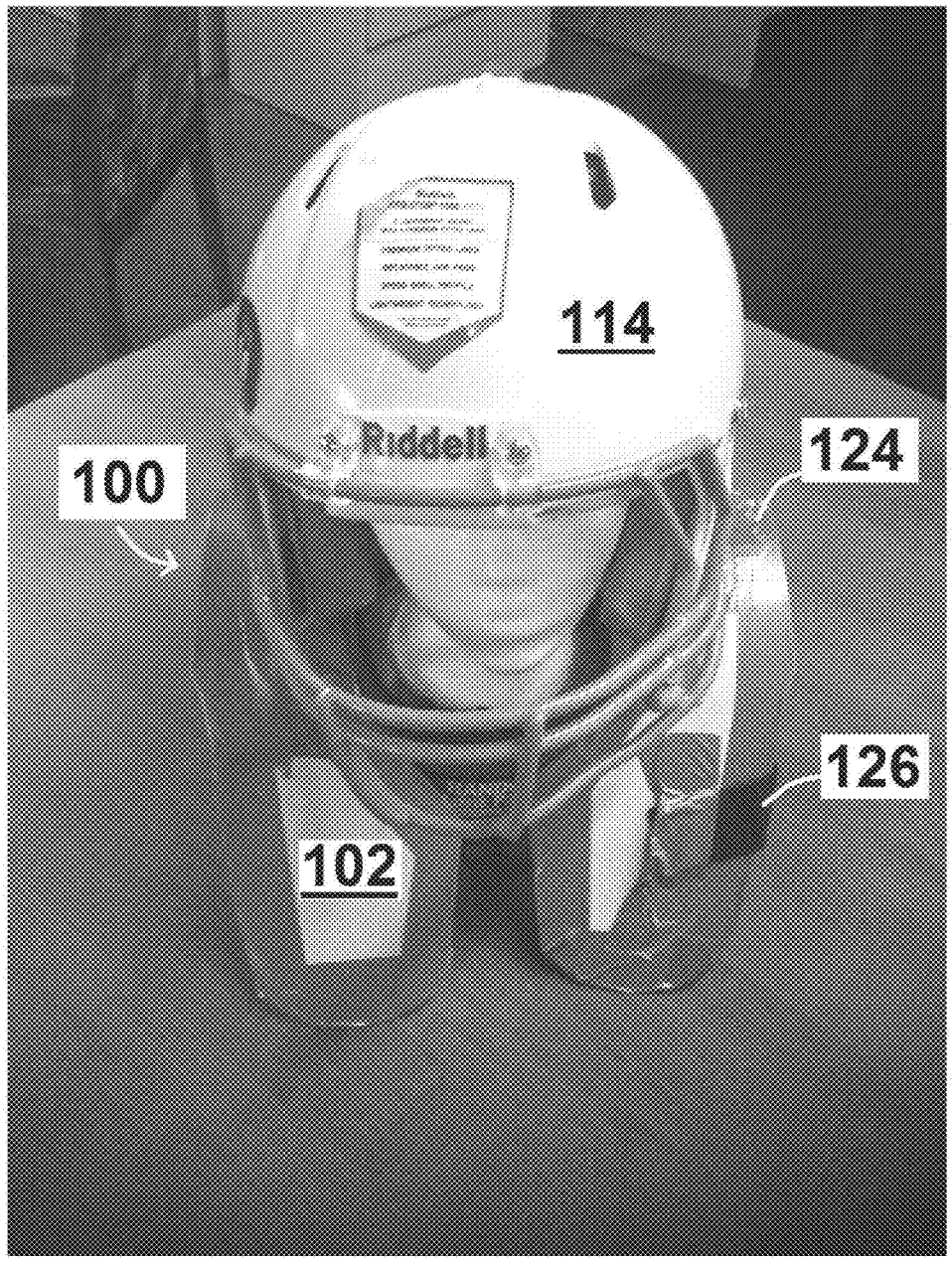
FIG. 6 shows a front view of components of a system, according to an exemplary embodiment of the present disclosure.
Figure 8:
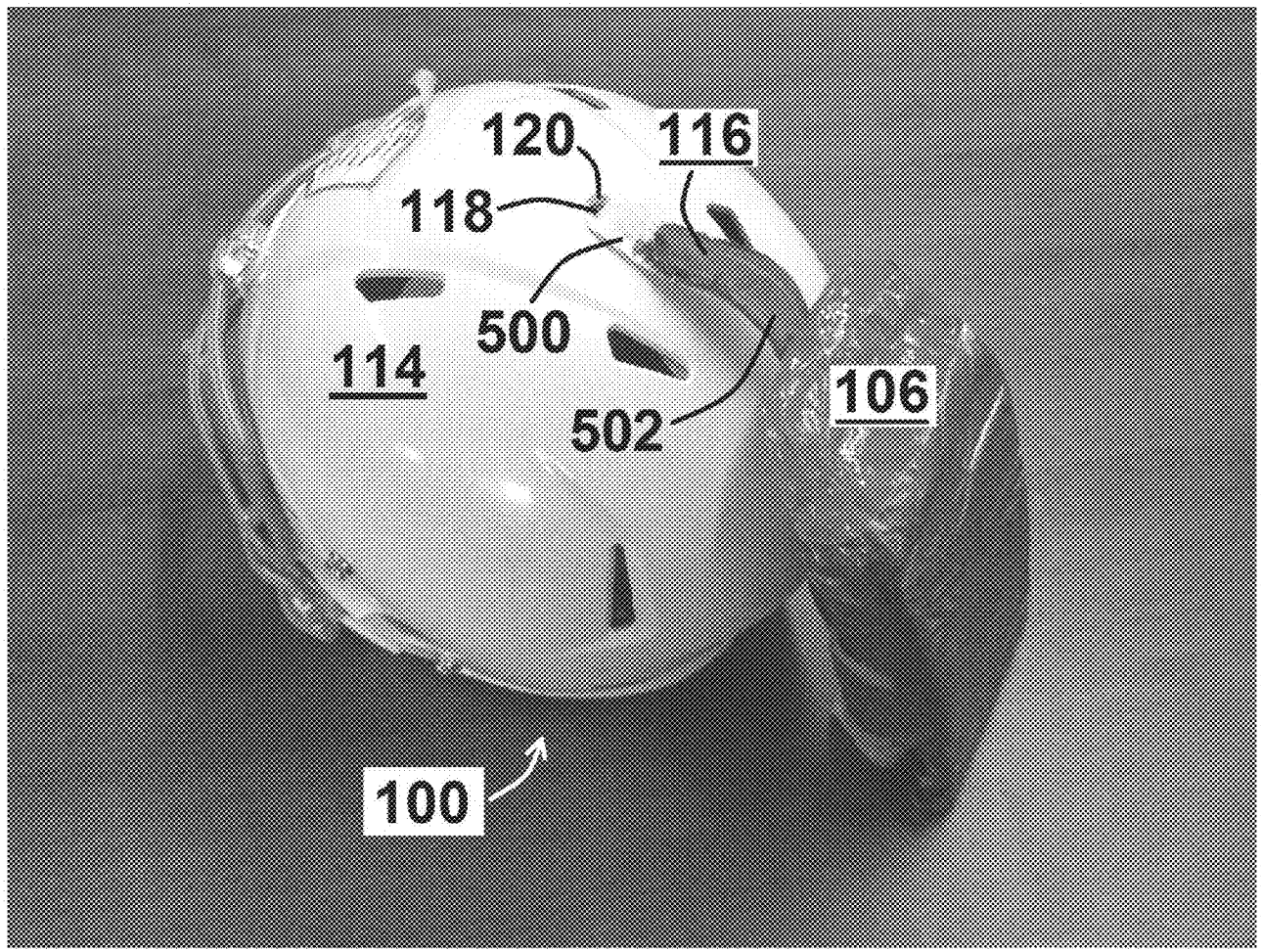
FIG. 8 shows a top perspective view of components of a system, according to an exemplary embodiment of the present disclosure.
Figure 9:
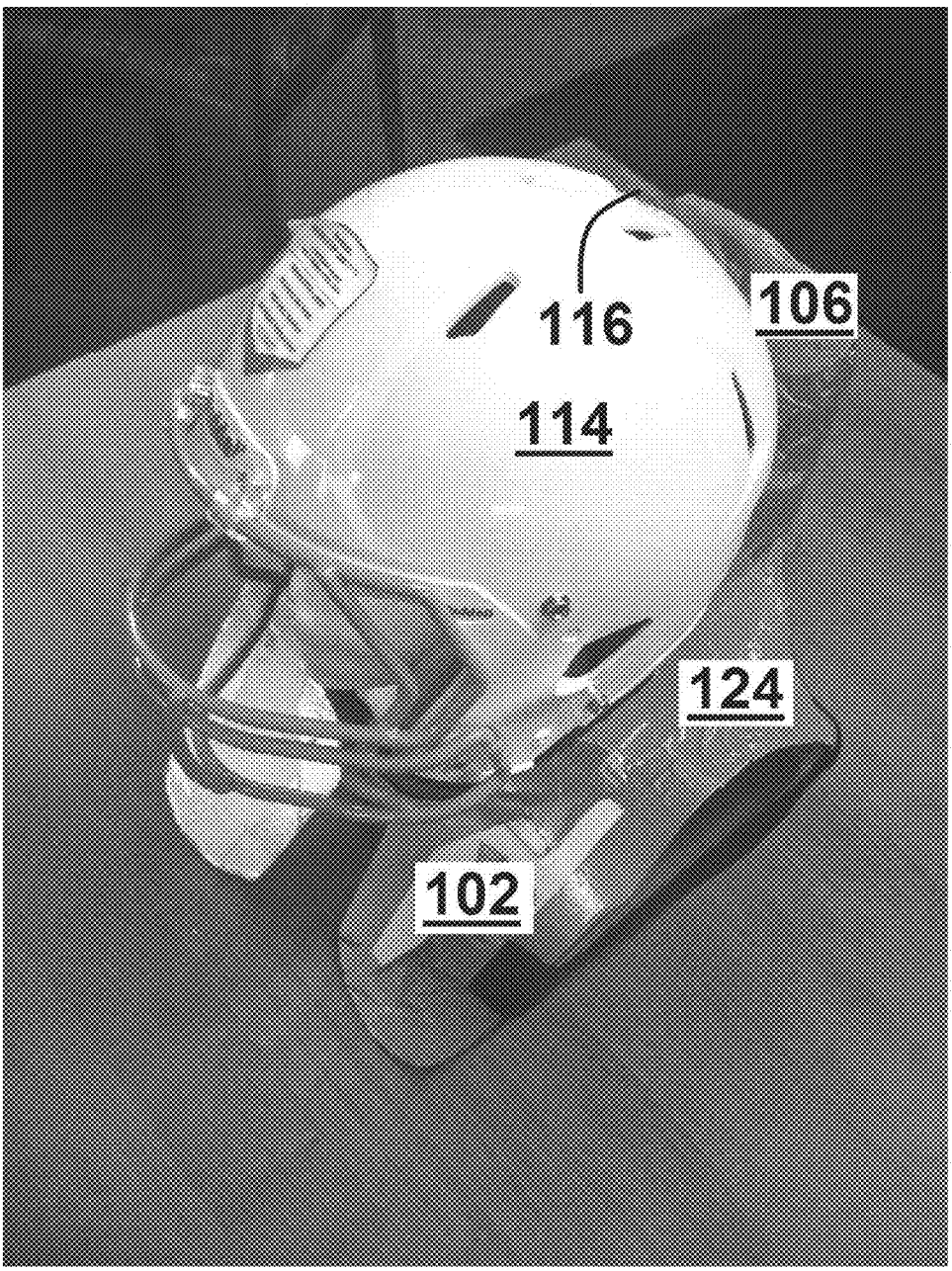
FIG. 9 shows a top-side perspective view of components of a system, according to an exemplary embodiment of the present disclosure.
Figure 11:
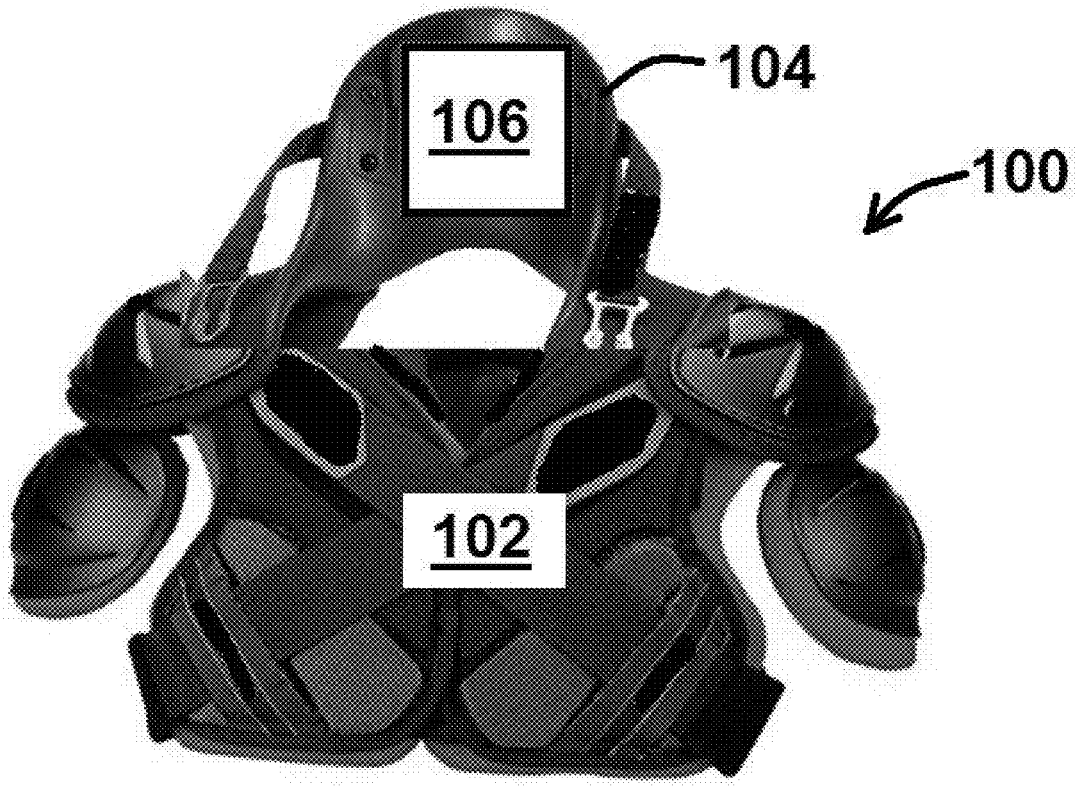
FIG. 11 shows a front view of certain components of a system, according to an exemplary embodiment of the present disclosure.

In addition to the aforementioned figures, the present disclosure includes several additional figures, some briefly mentioned above. FIG. 5 shows an exemplary tension strap 116, and FIGS. 6 and 7 show front and back views, respectively, of components of an exemplary system 100. FIG. 8 shows a top perspective view of components of an exemplary system 100, and FIG. 9 shows a top-side perspective view of components of an exemplary system 100. FIG. 11 shows a front view of certain components of an exemplary system 100, whereby flange cushion 106 is coupled to a relative front of shoulder flange 104.

Figure 10:
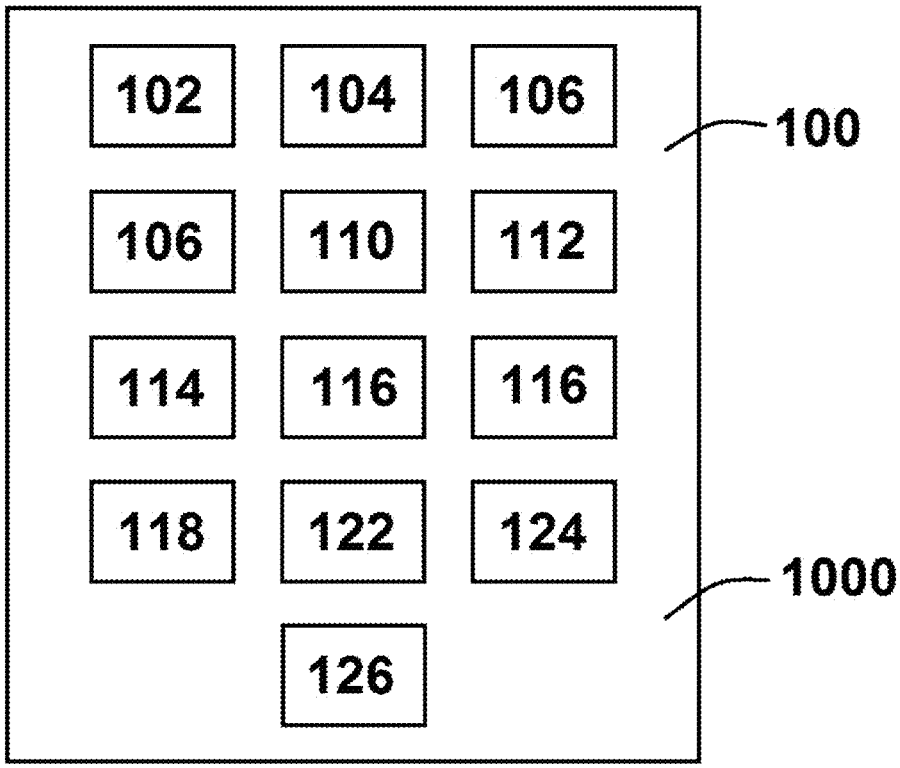
FIG. 10 shows a block component diagram of components of a system and/or kit, according to exemplary embodiments of the present disclosure.

FIG. 10 shows a block component diagram of components of a system or kit, according to an exemplary embodiment of the present disclosure. As shown therein, system 100 or kit 1000 may comprise some or all components referenced therein, or multiples of certain elements, such as flange cushions 106 and tension straps 116. For example, an exemplary kit 100 of the present disclosure may comprise one or more flange cushions 106, tension straps 116, and/or one or more additional components as referenced herein.

Figure 12:
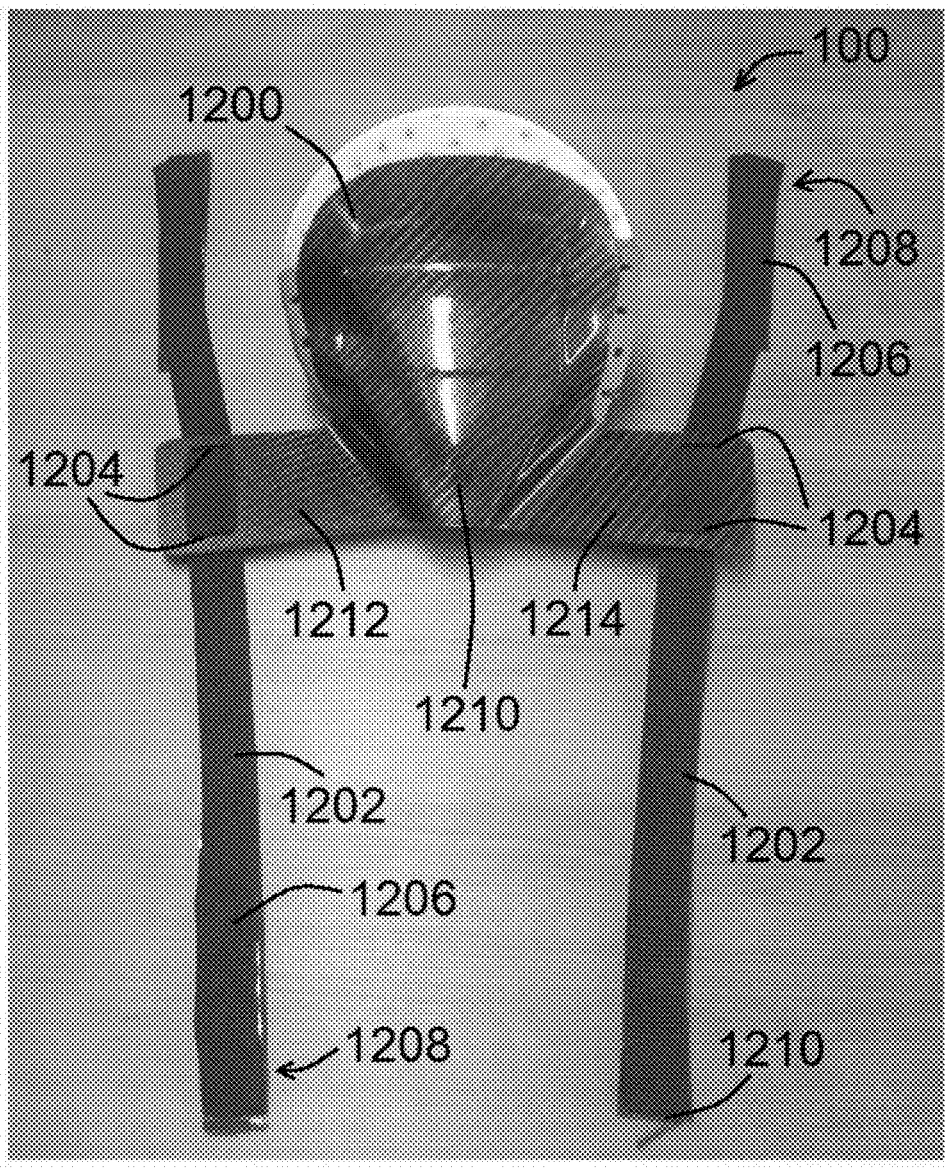
FIG. 12 shows a back view of a plate with straps of a system, according to an exemplary embodiment of the present disclosure.

An additional embodiment of a system 100 of the present disclosure is shown in FIG. 12. As shown in FIG. 12, an exemplary system 100 comprises a shoulder flange 104, configured as a plate 1200 that will, when worn by a user, be positioned across the user's back while shoulder apparatus 102, configured as or comprising elongated straps 1202, is positioned at least partially above the user's shoulders. FIG. 12 shows an image of a relative back of an exemplary system 100 of the present disclosure, with straps 1202 woven into plate 1200 within apertures 1204 defined therein. In at least one system 100 embodiment, and as shown in FIG. 12, plate 1200 comprises at least four apertures 1204, with two apertures 1204 on either relative side, and with one aperture 1204 being positioned above a second aperture 1204 on either side and configured to allow strap 1202 to be inserted into one aperture 1204 and subsequently inserted into another aperture 1204 so that strap 1202 engages plate 1200. Straps 1202, in various embodiments, may further comprise a hook and loop fastener portion 1206 (such as Velcro®) at or near one or more ends of one or more straps 1202. Hook and loop fastener portion 1206 can be used to secure one or more ends 1208 of straps 1202 to itself and/or to part of a shoulder pad apparatus 102, as referenced in further detail herein. The term "hook and loop fastener" refers to the use of the two-part system whereby one part is applied to one object and another corresponding part is applied to another object, so that when the two parts meet, they are held together using the hook and loop system.

As shown in FIG. 12, an exemplary shoulder flange 104, configured as a plate 1200, comprises a central portion 1210, a first side portion 1212, and a second side portion 1214, wherein each portion 1210, 1212, 1214 are connected so that central portion 1210 is in between first side portion 1212 and second side portion 1214. In at least one embodiment, two apertures 1204 are defined within first side portion 1212 and two additional apertures 1204 are defined within second side portion 1214. As noted above, and in at least one embodiment, two apertures 1204 are positioned so that one is above the other when viewing system 100 as shown in FIG. 12. When system 100 is positioned upon a user wearing traditional football shoulder pads (an exemplary shoulder apparatus 102), for example, first side portion 1212 and second side portion 1214 are positioned at the user's back upon the shoulder pads, and movement of central portion 1210 in a direction away from the user is limited because of first side portion 1212 and second side portion 1214 and straps 1202 secured to the shoulder pads.

Figure 13:
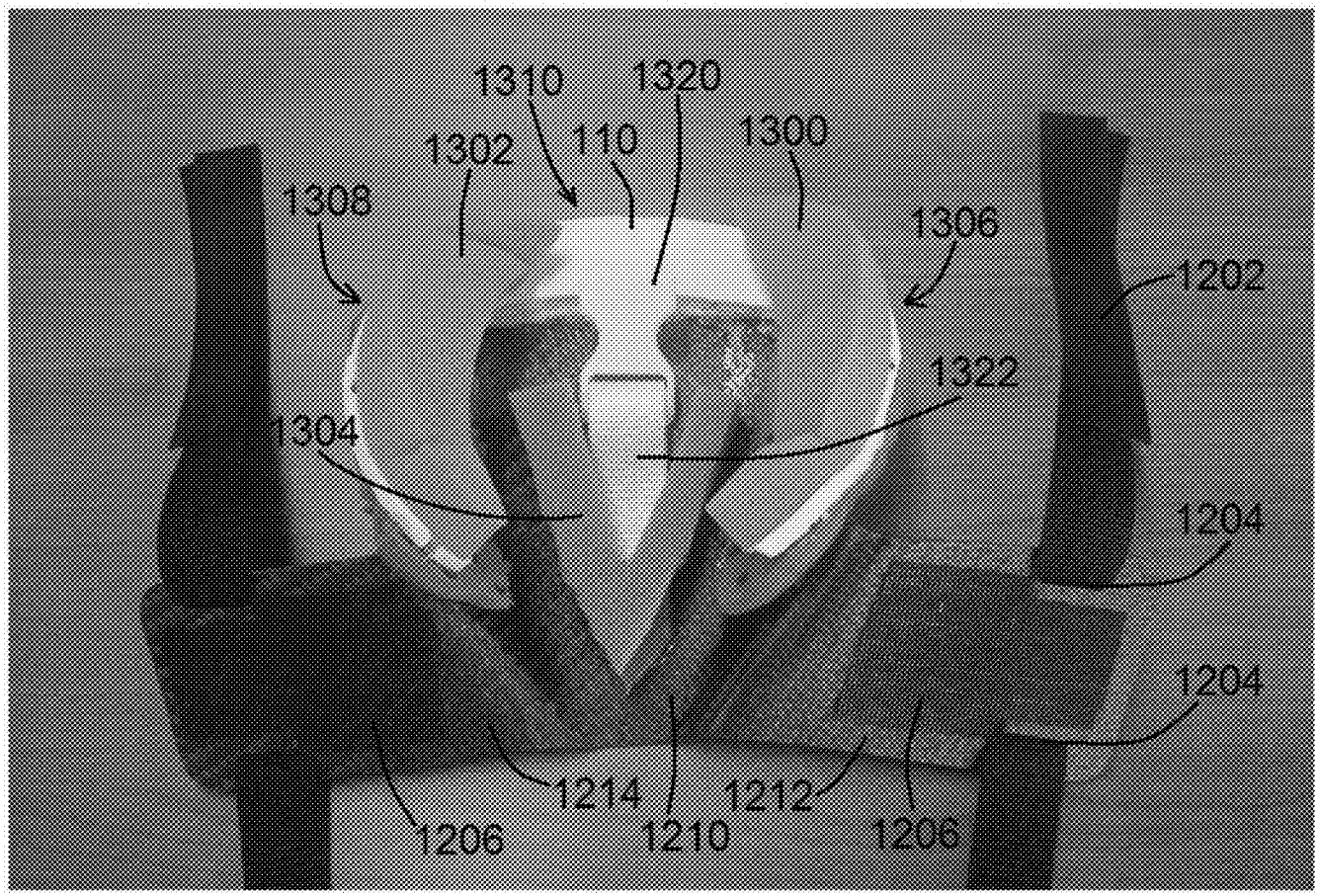
FIG. 13 shows a front/side view of a plate with straps of a system, according to an exemplary embodiment of the present disclosure.

FIG. 13 shows a view of a relative front of portions of an exemplary system 100 of the present disclosure. As shown in FIG. 13, plate 1200 (an exemplary shoulder flange 104 of the present disclosure) is shown having a central portion 1210, a first side portion 1212, and a second side portion 1214. First side portion 1212 and second side portion 1214 each have defined at least two apertures 1204 defined therein so that straps 1202 can be woven therein as shown in the figure and as shown in FIG. 12.

FIG. 13 also shows various pads/cushions useful in various system 100 embodiments. For example, and as shown in FIG. 13, an exemplary system 100 of the present disclosure comprises a flange pad 110 (as generally referenced herein), a first side cushion 1300, a second side cushion 1302, and a central cushion 1304, located on central portion 1210 of plate 1200 at or near a first side 1306, a second side 1308, and at a relative center 1310, of central portion 1210, respectively. First side cushion 1300 and second side cushion 1302 can have a curved shape, as shown in FIG. 13, so to confirm to a general curved contour of a back of a football helmet, for example. Central cushion 1304 is configured to confirm to a relative middle of a back of a football helmet, and may comprise a v-shape, as shown in FIG. 13, to provide additional cushion support relative to a helmet. Flange pad 110, in various embodiments, is configured so to be coupled to shoulder flange 104/plate 1200 and have a portion extending therefrom so that, for example, should a player attempt to tackle a person wearing an exemplary system 100 of the present disclosure by grabbing flange pad 110, the attempted tackler would lose grip as the portion of flange pad 110 able to be grabbed would flip down away from the person wearing system 100. Furthermore, flange pad 110 may be brightly colored and/or colored in a way that should someone attempt to grab flange pad 110, it would be readily noticeable by a sporting official, for example, so that an appropriate penalty could be called.

As discussed in further detail herein, plate 1200 may be secured to headgear 114 (such as a football helmet, for example), using a clasp 1320 and an optional clasp strap 1322, whereby clasp 1320 and/or clasp strap 1322 are coupled to plate 1200. In addition to straps 1202 used to connect plate 1200 to a shoulder apparatus 102, for example, hook and loop fastener 1206 may also be coupled to plate 1200, such as at first side portion 1212 and second side portion 1214, so that hook and loop fastener 1206 can attach to and detach from additional hook and loop fastener 1206 (such as an opposite part than used on plate 1200) positioned upon shoulder apparatus 102.

Figure 14:
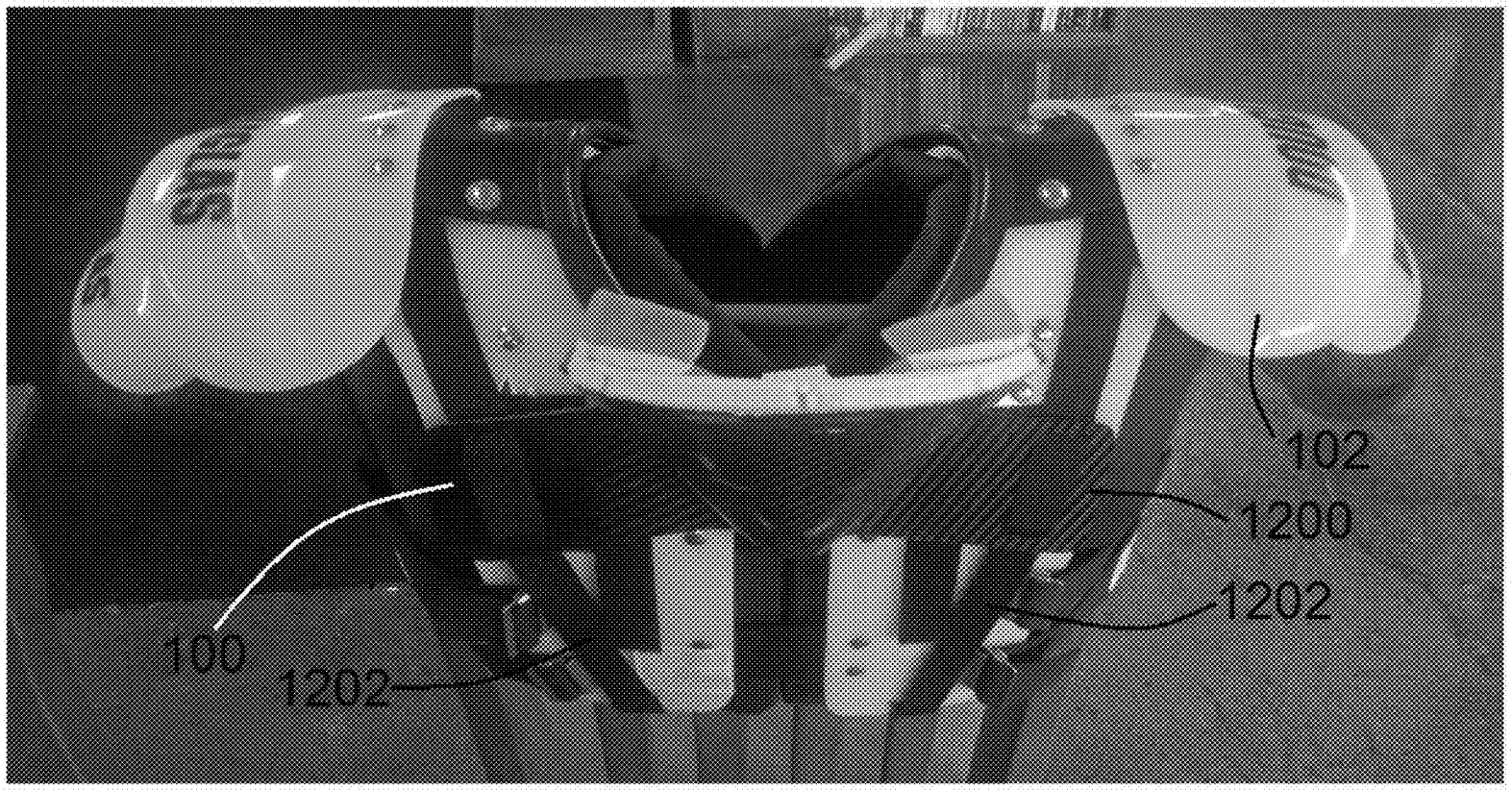
FIG. 14 shows a system coupled to a shoulder apparatus, according to an exemplary embodiment of the present disclosure.

FIG. 14 shows an exemplary system 100 of the present disclosure connected to an exemplary shoulder apparatus 102, with the back of shoulder apparatus 102 shown in the figure. As shown in FIG. 14, straps 1202 on each side of plate 1200 are connected to upper and lower portions of shoulder apparatus 102, such as by using hook and loop fasteners 1206. Plate 1200, as shown in FIG. 14, is positioned along a back side of shoulder apparatus 102 and on the outside of shoulder apparatus 102. When system 100 is secured to shoulder apparatus 102 (using straps 1202 and/or hook and loop fasteners 1206 as referenced herein), someone grabbing portions of system 1000 during a sporting event would not be able to remove system 100 from shoulder apparatus 102. As shown in FIG. 14, when system 100 is properly secured to shoulder apparatus 102, and when a helmet (headgear 114) is worn, system 100 is configured to minimize or eliminate the ability for someone to perform a horse-collar tackle of a player wearing system 100, due to the relative positioning of helmet 114, various cushions/padding, and/or shoulder flange 104/plate 1200. Instances of horse-collar tackles, and therefore potential injury due to the same, can be diminished for those wearing various system 100 embodiments referenced herein. As shown in the figures and generally described herein, various elements of system 100, such as plate 1200, shoulder flange 104, etc., are configured to fit external to shoulder apparatus 102, so to allow for a "universal fit" upon any number/size of shoulder apparatus 102 embodiments. For example, if plate 1200 was secured to the inside of shoulder apparatus 102, no adjustments could be made as to the relative distance between plate 1200 and headgear 114. In addition, and should plate 1200 be inside shoulder apparatus 102 and should someone attempt to grab an upper portion of plate 1200 and pull down and away from the person wearing plate 1200, plate 1200 would dig into the player's body, versus applying pressure to the outside of shoulder apparatus 102, causing discomfort and potential injury as opposed to being an effective safety feature if worn as shown in FIG. 14.

Figure 15:
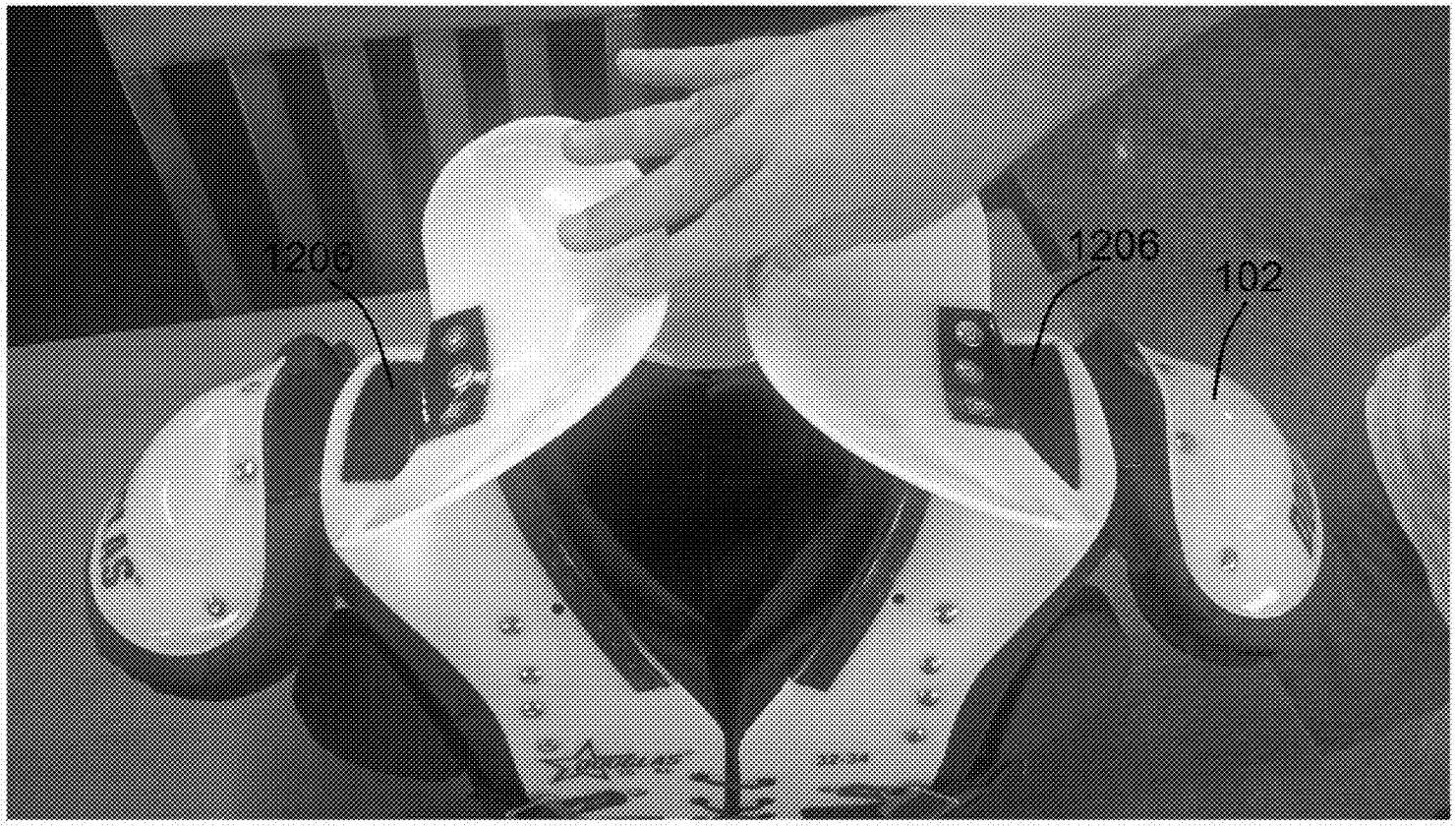
FIGS. 15, 16, and 17 show a modified shoulder apparatus, according to exemplary embodiments of the present disclosure.
Figure 16:
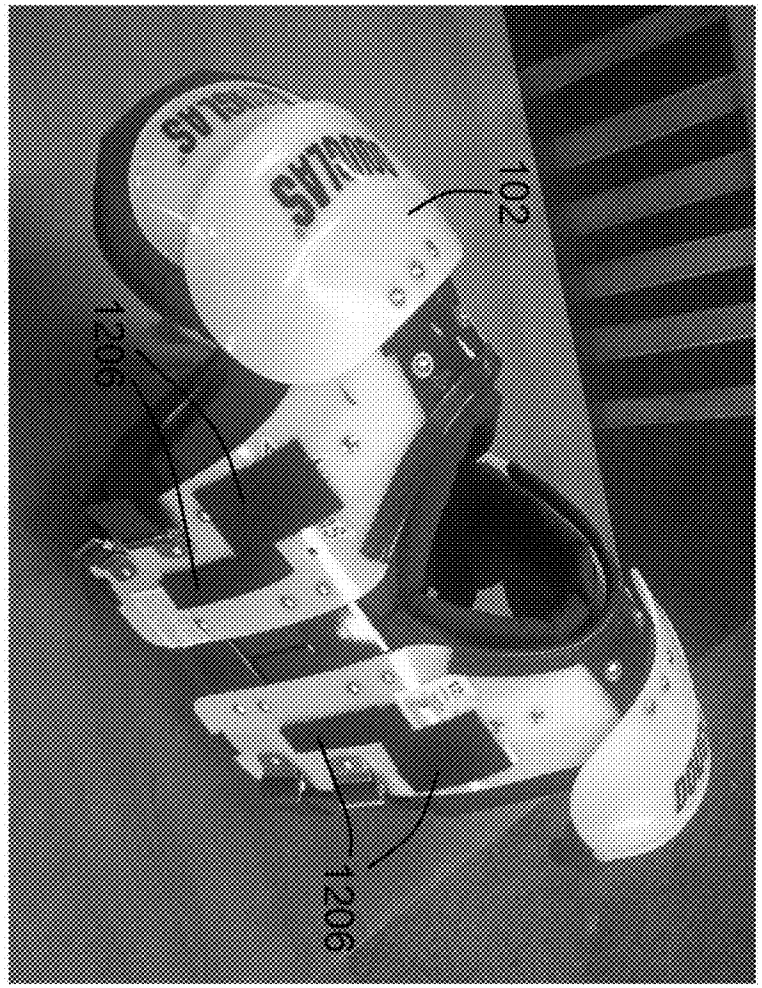
Figure 17:
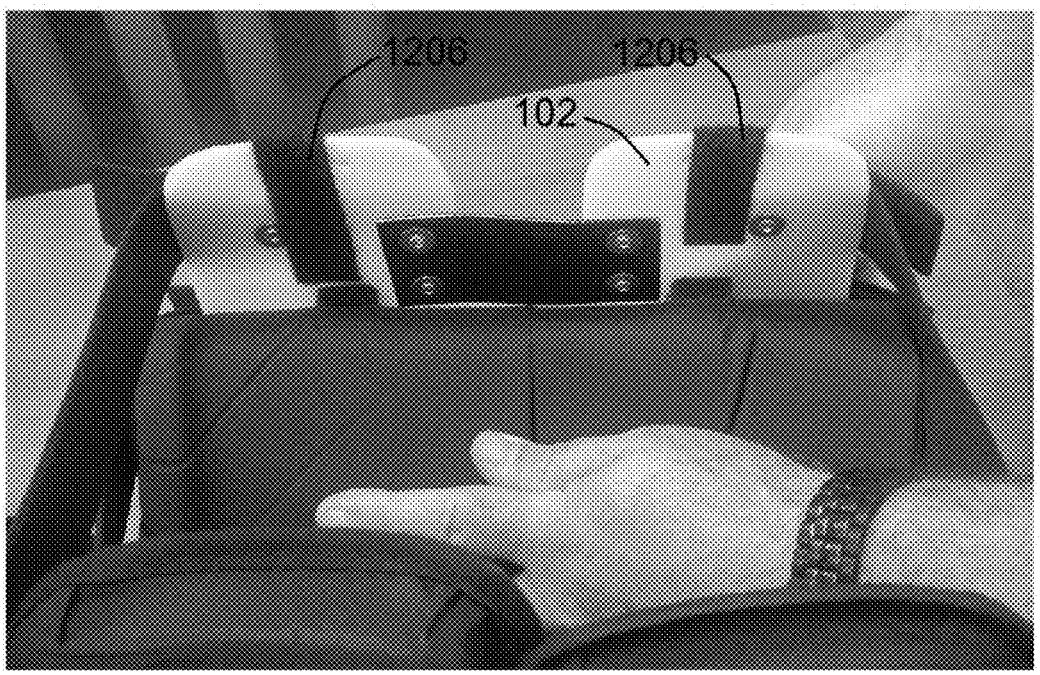

FIG. 15 shows modifications to an exemplary shoulder apparatus 102, whereby hook and loop fasteners 1206 are applied to shoulder apparatus 102 at the shoulder region. As shown in FIG. 15, the hook and loop fastener portion 1206 applied to shoulder apparatus 102 can be used to connect a separate hook and loop fastener portion 1206, such as applied to a strap 1202 as referenced and shown herein, so to secure strap 1202, and thereby system 100, to shoulder apparatus 102. Hook and loop fastener portion 1206 can also be applied to other portions of shoulder apparatus 102, such as on the relative back as shown in FIG. 16, so that corresponding hook and loop fastener 1206 upon plate 1200, such as shown in FIG. 13, can be attached thereto so to further secure plate 1200 upon shoulder apparatus 102 as desired. Similarly, hook and loop fastener portion 1206 can also be applied to an inner portion of shoulder apparatus 102 at a relative bottom, such as shown in FIG. 17, so that corresponding hook and loop fastener 1206 upon straps 1202, such as shown in FIG. 12, can be attached thereto so to further secure system 100 to shoulder apparatus 102 as desired.

Figure 18:
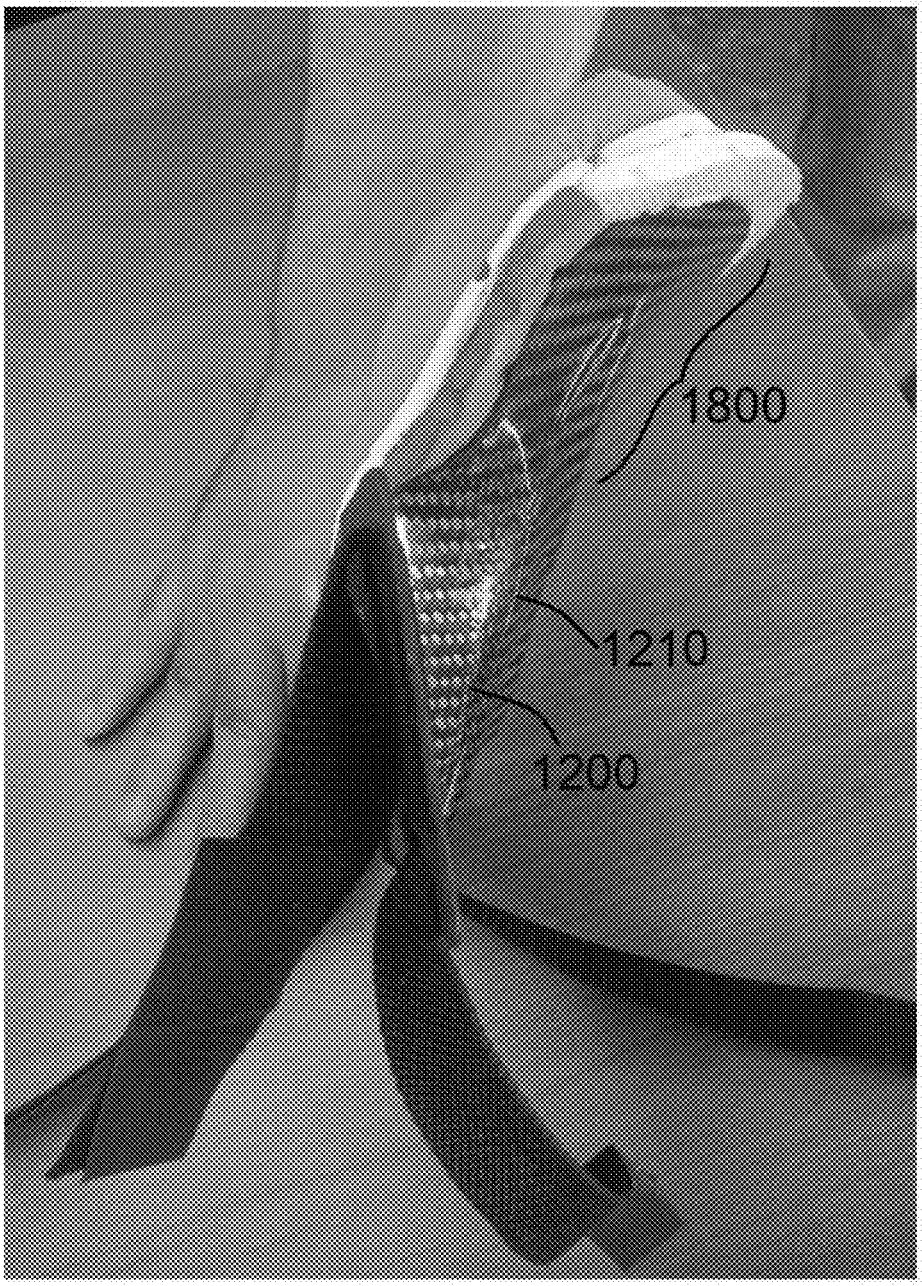
FIG. 18 shows a side perspective view of a plate, according to an exemplary embodiment of the present disclosure.

FIG. 18 shows a side perspective view of an exemplary plate 1200 of the present disclosure. As shown therein, and in at least one embodiment of the present disclosure, central portion 1210 of plate may define/comprise an outwardly curved region 1800, configured for use in situations where an exemplary system 100 requires an outwardly curved region 1800 due to helmet and/or padding size(s) and/or placement relative to plate 1200 when plate 1200 is positioned upon shoulder apparatus 102. However, in other plate 1200 embodiments, central portion 1210 may not have a curved region 1800, instead being relatively straight. In various embodiments, central region 1210 may comprise a general half-conical shape (tapering down to the bottom and protruding outward), or a relatively boxy shape, whereby a protruding part of central portion 1210 may be relatively flat, similar to how first side portion 1212 and second side portion 1214 of plate 1200 are depicted in FIG. 12. In various embodiments, first side portion 1212 and second side portion 1214 of plate may also be curved outward (from top to bottom), so to more closely mirror an outwardly-curved portion of an exemplary shoulder apparatus 102.

Figure 19:
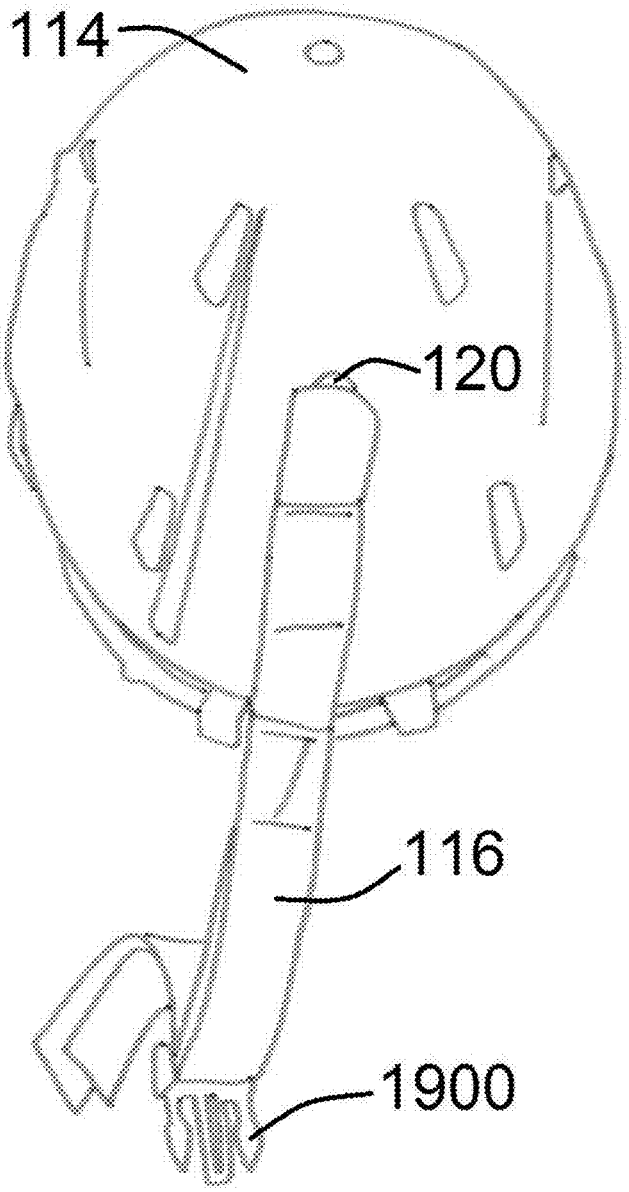
FIG. 19 shows headgear connected to a tensile strap, according to an exemplary embodiment of the present disclosure.

FIG. 19 shows a relative top portion of a helmet (exemplary headgear 114) with a tensile strap 116 connected thereto. Tensile strap 116 connects to headgear 114 using an exemplary attachment element 118 (not shown in FIG. 19, but shown in FIG. 5 and referenced and shown in following figures as noted below), and in at least one embodiment, can connect to clasp 1320 (shown in FIG. 13) by way of connector 1900 coupled to tensile strap 116. When attachment element 118 is used to connect tensile strap 116 to headgear 114, and when clasp 1320 is connected to connector 1900, headgear 114 is effectively attached to plate 1200 of system 100 when system 100 is being worn.

Figure 20B:
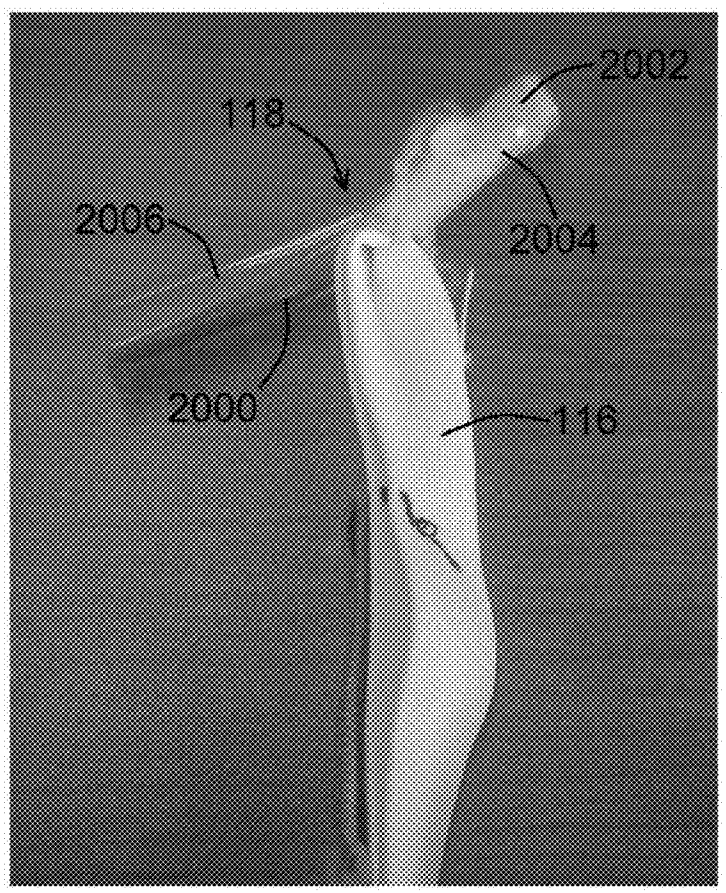
FIGS. 20A and 20B show an attachment element in two configurations, according to exemplary embodiments of the present disclosure.
Figure 20A:
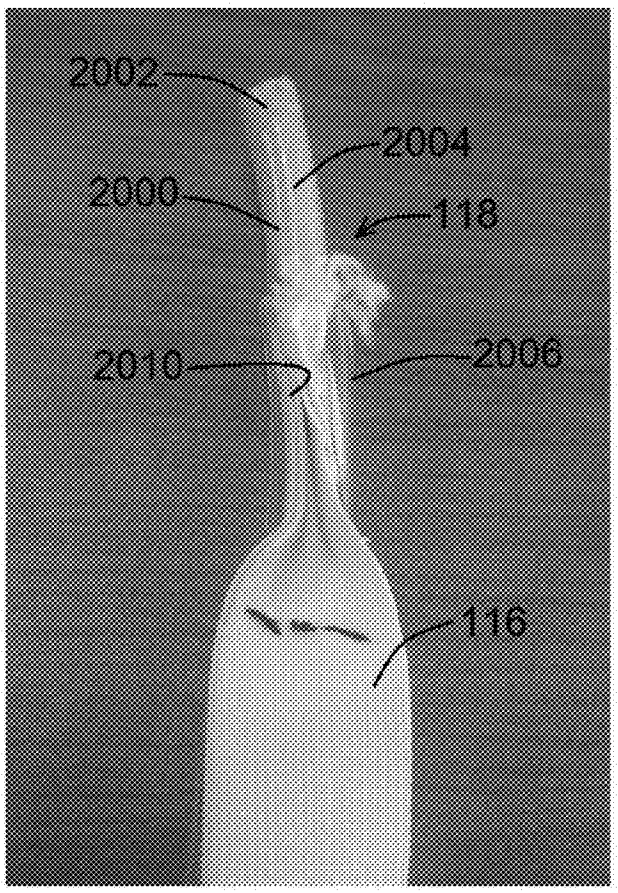
Figure 21:
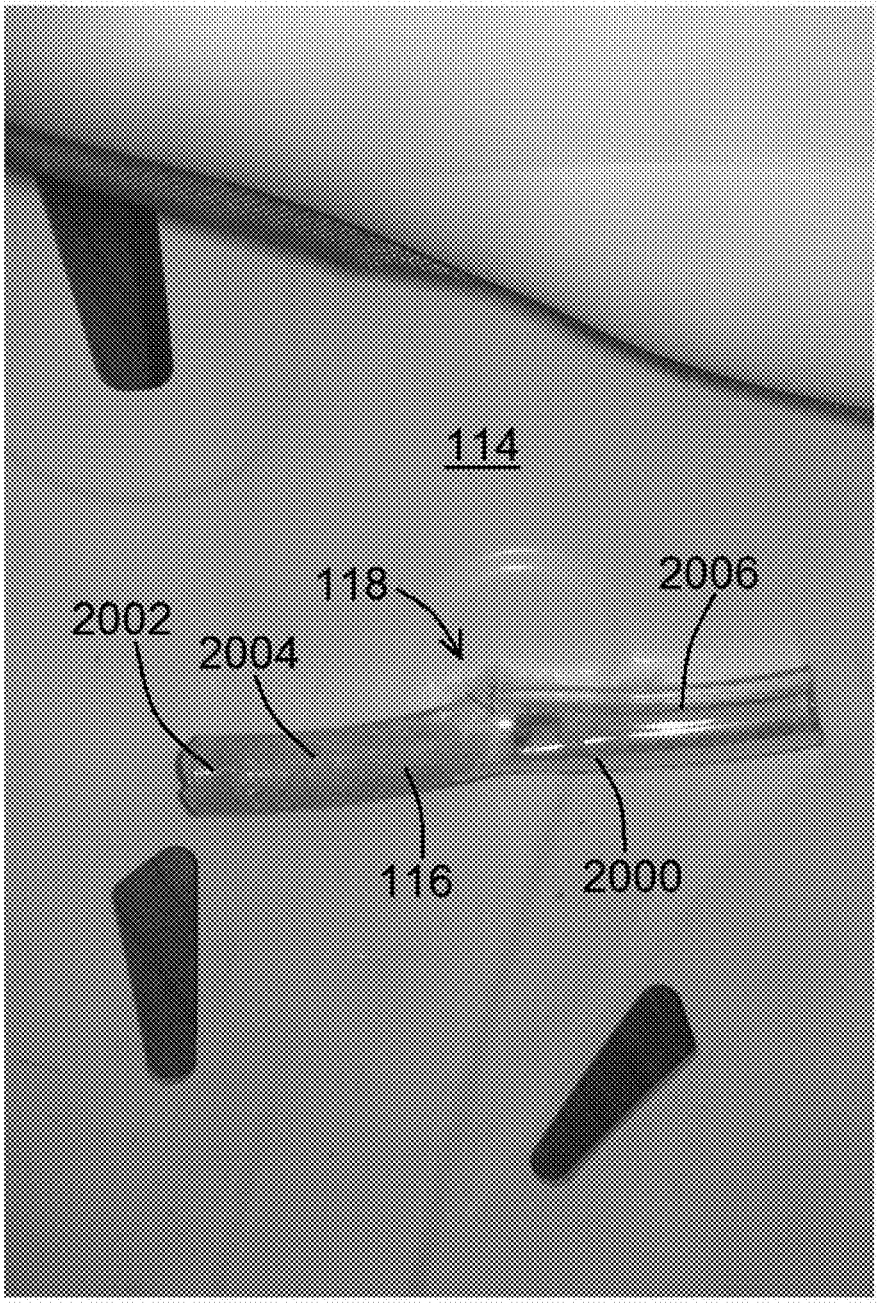
FIG. 21 shows an inside view of headgear with an attachment element therein, according to an exemplary embodiment of the present disclosure.
Figure 22:
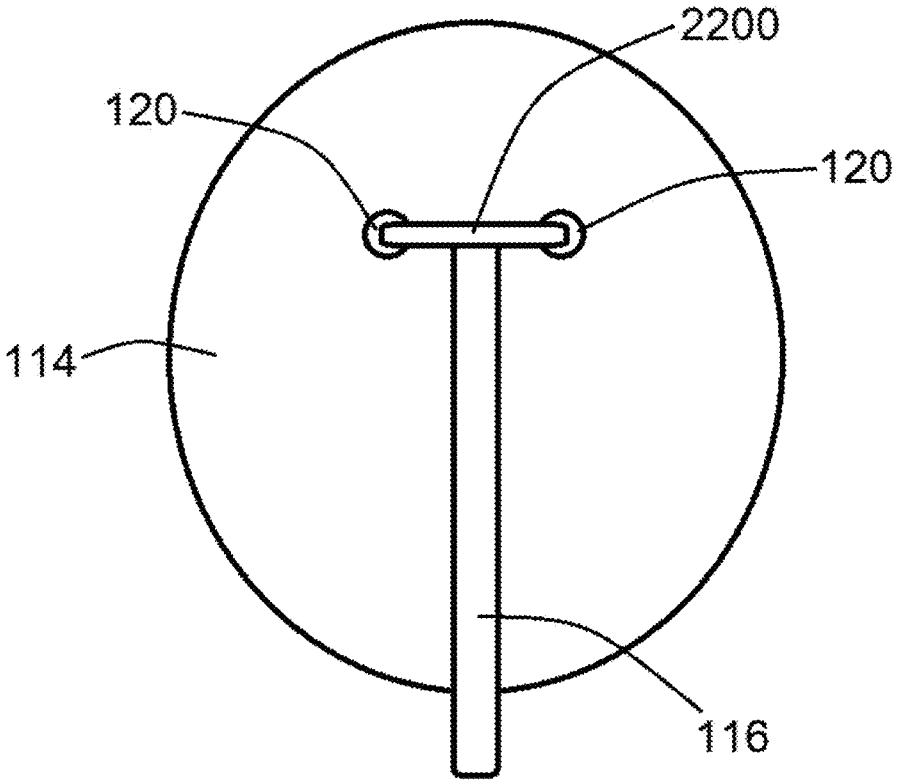
FIG. 22 shows a top view of headgear with an adapter and a tensile strap, according to an exemplary embodiment of the present disclosure.

FIGS. 20A and 20B show an exemplary embodiment of an attachment element 118 of the present disclosure. As shown therein, attachment element 118 comprises tubing 2000, such as silicone tubing or another type of flexible tubing, whereby a relative end of tensile strap 116 is positioned within tubing 2000 and secured therein (such as, for example, by way of an adhesive 2002 within tubing 2000. A first portion 2004 of tubing 2000, in such an attachment element 118 embodiment, is secured to tensile strap 116, while a second portion 2006 of tubing 2000 is not secured to tensile strap 116, but instead forms a unitary tubing 2000 along with first portion 2006. Second portion 2006, in at least one embodiment, can move between a relatively "closed" configuration, such as shown in FIG. 20A, and a relatively "open" configuration, such as shown in FIG. 20B. The relatively closed configuration, in at least one embodiment, is achieved by way of placing part of tensile strap 116 within second portion 2006 of tubing 2000, such as through a slit 2010 within second portion 2006 of tubing 2000. The closed configuration can, for example, facilitate insertion of tubing 2000 into headgear aperture 120. Once inserted, second portion 2006 can be moved to a relatively open configuration, such as shown in FIG. 20B, by removing the part of tensile strap 116 within second portion 2006 of tubing 2000, so that the first portion 2004, the second portion 2006, and tensile strap 116 not in first portion 2004, forms a "T" or a "Y" configuration so to retain such an attachment element 118 embodiment within headgear 114, such as shown in the inside view of headgear 114 shown in FIG. 21 with an open configuration attachment element 114 therein. In an embodiment of headgear 114 having two headgear apertures 120, for example, either two tensile straps 116 could be secured to headgear 120, or one tensile strap 116 having two portions to secure to headgear 120, could be used. Furthermore, an adapter 2200 (shown in FIG. 22) useful to connect two portions of a tensile strap 116 to one another, to connect two tensile straps 116 to one another, or to connect to two headgear apertures 120 and one tensile strap 116 (with such an embodiment shown in FIG. 22), could be used depending on headgear 120 configuration.

Portions of system 100, such as plate 1200 and cushions/padding thereon, help to support a relatively heavy helmet, such as worn by a youth football player. By securing system 100 to shoulder apparatus 102, headgear 114 is supported by one or more of tensile strap 116, shoulder flange 104, flange cushion 106, flange pad 110, shoulder cushion 124, plate 1200, first side cushion 1300, second side cushion 1302, and/or central cushion 1304.

In at least one embodiment of a system 100 of the present disclosure, system 100 is configured to fit inside of a jacket, such as a leather rodeo jacket, to provide general support to the rodeo athlete.

Tensile straps 116 may be prepared in various lengths, widths, layers, and tensions, configured for a particular use, such as with an athlete of a particular height, weight, and/or age. For example, an exemplary kit 1000 of the present disclosure may comprise two or more tensile straps 116 having different properties (length, tensile strength, etc.).

Figure 23:
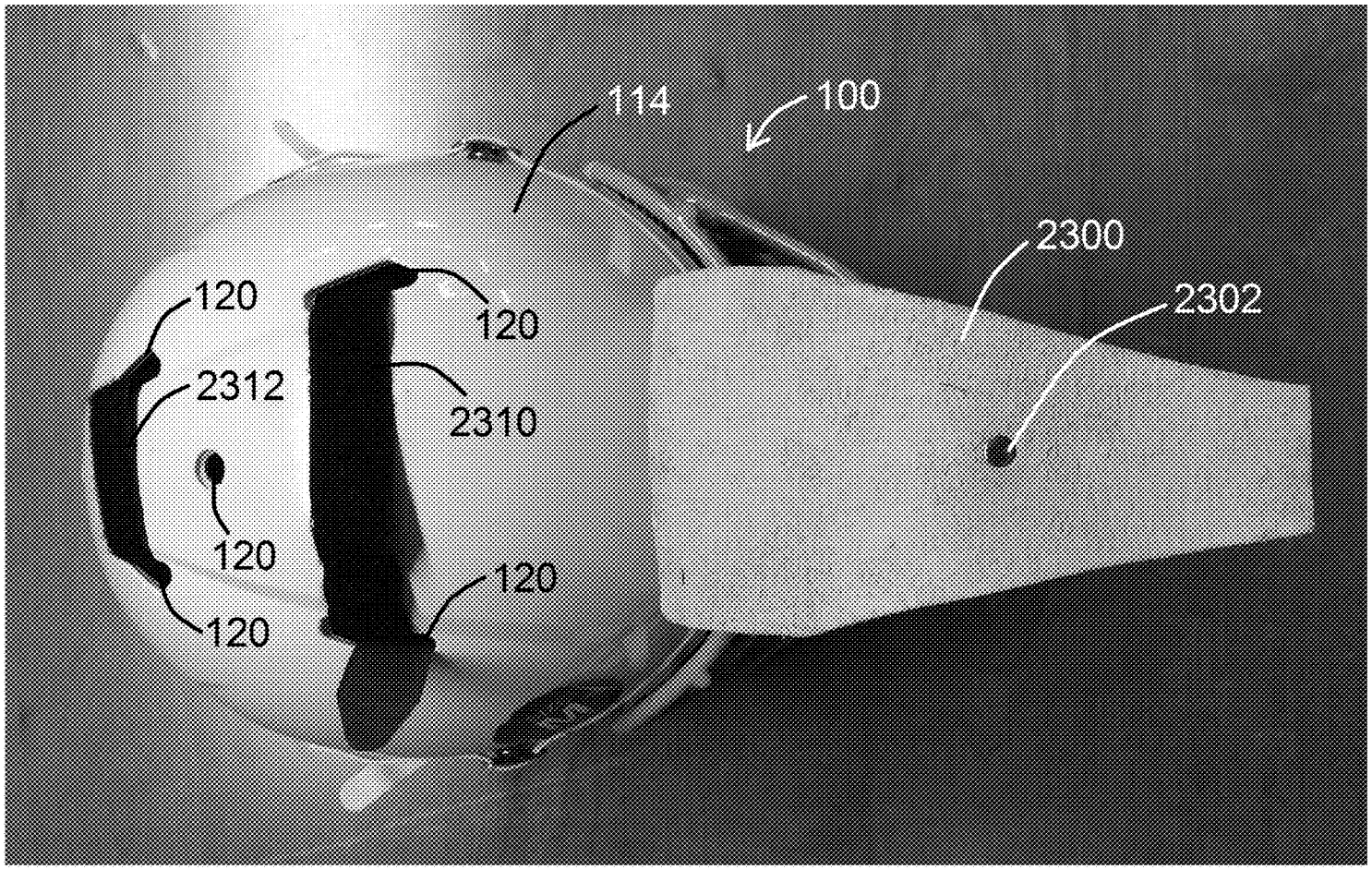
FIG. 23 shows a top view of a headgear and an underside of a front anchor strap, according to an exemplary embodiment of the present disclosure.
Figure 24:
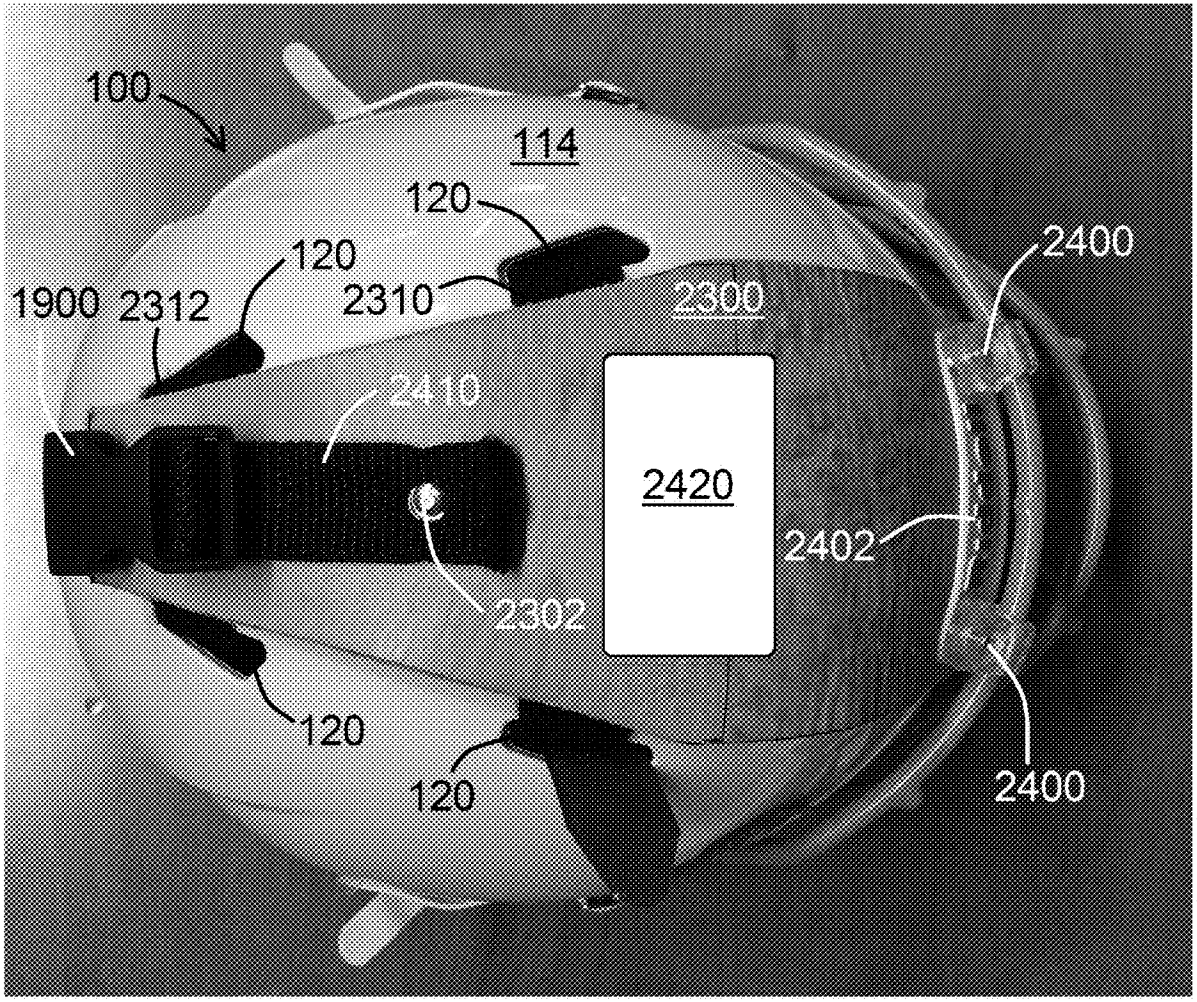
FIG. 24 shows a top view of a headgear and an outside of a front anchor strap, according to an exemplary embodiment of the present disclosure.
Figure 25:
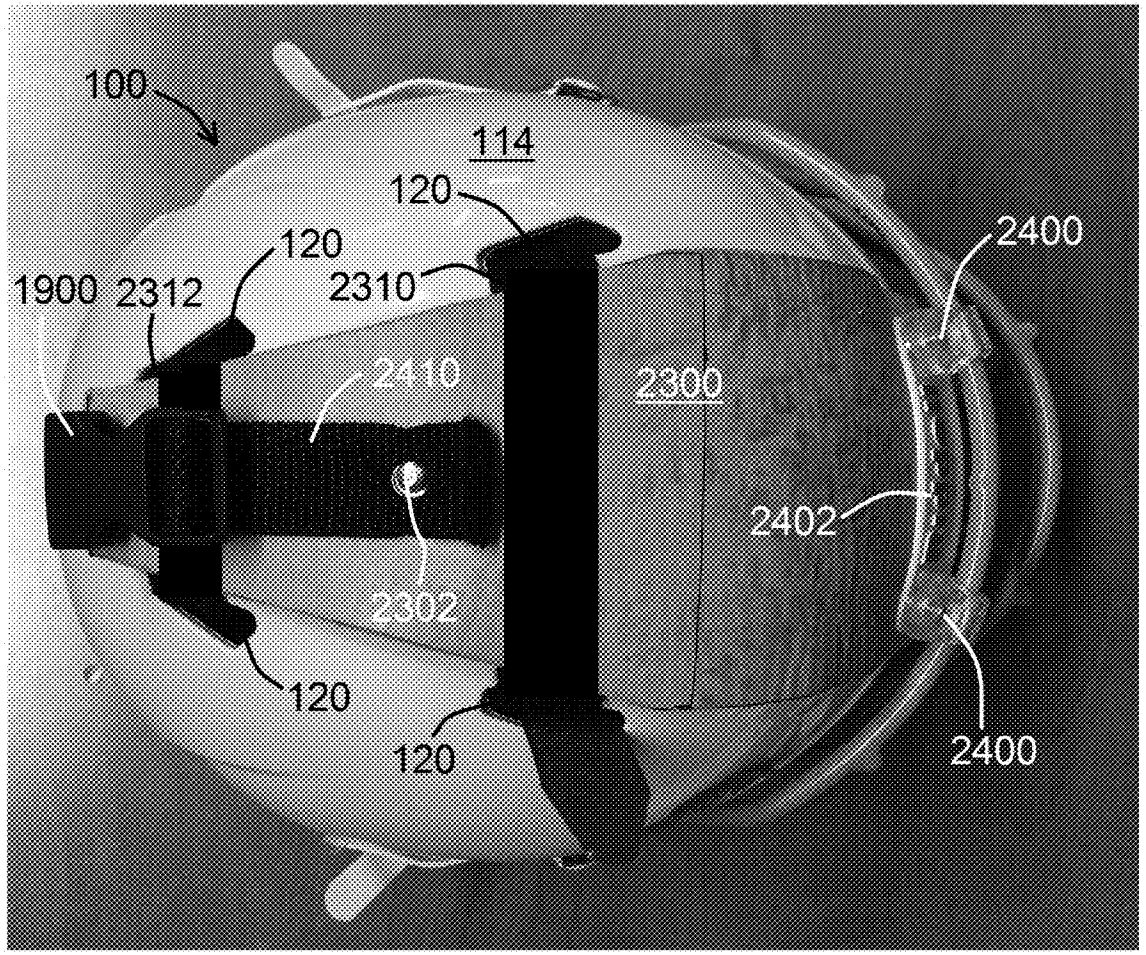
FIG. 25 shows a top view of a headgear and an outside of a front anchor strap with a first retainer and a second retainer holding the front anchor strap in place, according to an exemplary embodiment of the present disclosure.

An additional embodiment of portions of an exemplary system 100 of the present disclosure is shown in FIGS. 23-26. As shown in FIG. 23, a front anchor strap 2300 (underside/inside shown in FIG. 23, and outside shown in FIG. 24) comprises sturdy material (leather, plastic, fabric, etc.) which can be coupled directly or indirectly to headgear 114, such as by way of one or more fasteners 2400 (such as those used to couple the facemask of a football helmet to the helmet itself) and/or by way of an optional plate 2402, as shown in FIGS. 24 and 25. Front anchor strap 2300 can then extend from the fastening area along a relative top of headgear 114, such as shown in FIG. 24, so to provide a pivot point, by way of connector 2302, at or near a relative top/center of headgear 114. Some headgear 114 embodiments have a headgear aperture 120 at a relative top/center of headgear 114, such as shown in FIG. 23, which can be used as the pivot point as shown in other system 100 embodiments herein. One or more strap cushions 2420, such as shown in FIG. 24, can be coupled to front anchor strap 2420 to provide additional cushion/padding for the player if hit in that area by an opposing player, the ground, and/or the like.

Connector 2302, as shown in FIGS. 24 and 25, can connect a top anchor 2410 to front anchor strap 2300. Front anchor 2410, such as a length of a strap, can have a connector 1900 coupled thereto, allowing a strap 116 to connect thereto, such as shown in FIG. 26.

Figure 26:
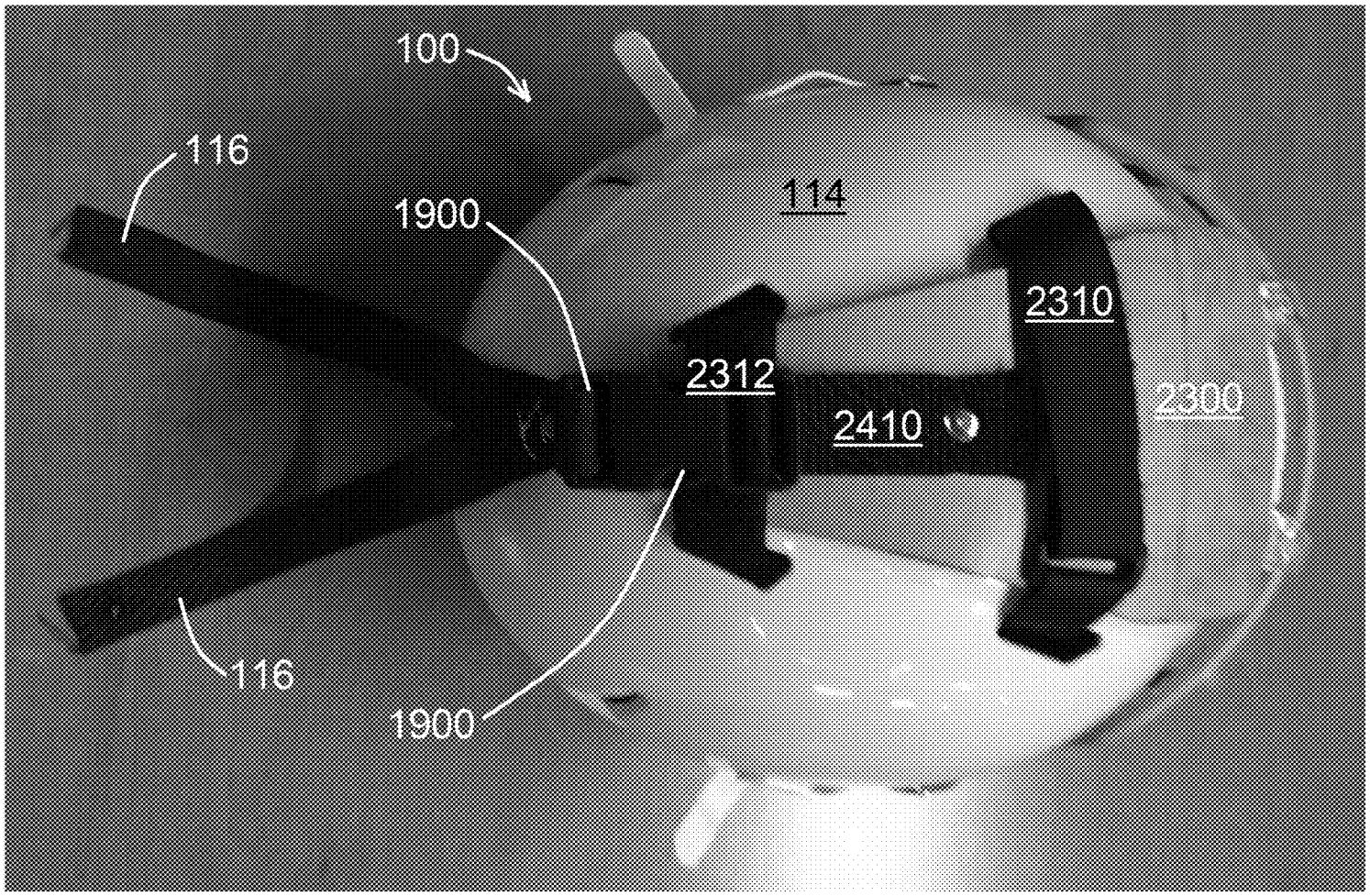
FIG. 26 shows a top view of a headgear and two straps coupled to a connector of a top anchor, according to an exemplary embodiment of the present disclosure.

Front anchor strap 2300 can be retained in place using one or more retainers, such as a first retainer 2310 and/or a second retainer 2312, as shown in FIGS. 25 and 26. Retainers 2310, 2312 can comprise lengths of strap having a hook and loop fastener portion 1206 (or another type of fastener portion) positioned at least partially within one or more headgear apertures 120, such as shown in FIGS. 24 and 25. Retainers 2310, 2312 may be viewed as universal, as potentially applying to all types of headgear 114 with apertures 1204 defined therein. When retainers 2310, 2312 are positioned over front anchor strap 2300 and secured in place, retainers 2310, 2312 secure front anchor strap 2300 to headgear 114. Strap 116, having its own connector 1900 (as shown in FIG. 26) can connect to connector 1900 of top anchor 2410. Strap 116 can be viewed as splitting from one strap 116 into two straps 116, such as shown in FIG. 26, and used to effectively couple headgear 114 to shoulder apparatus 102, as provided in further detail herein.

Figure 27:
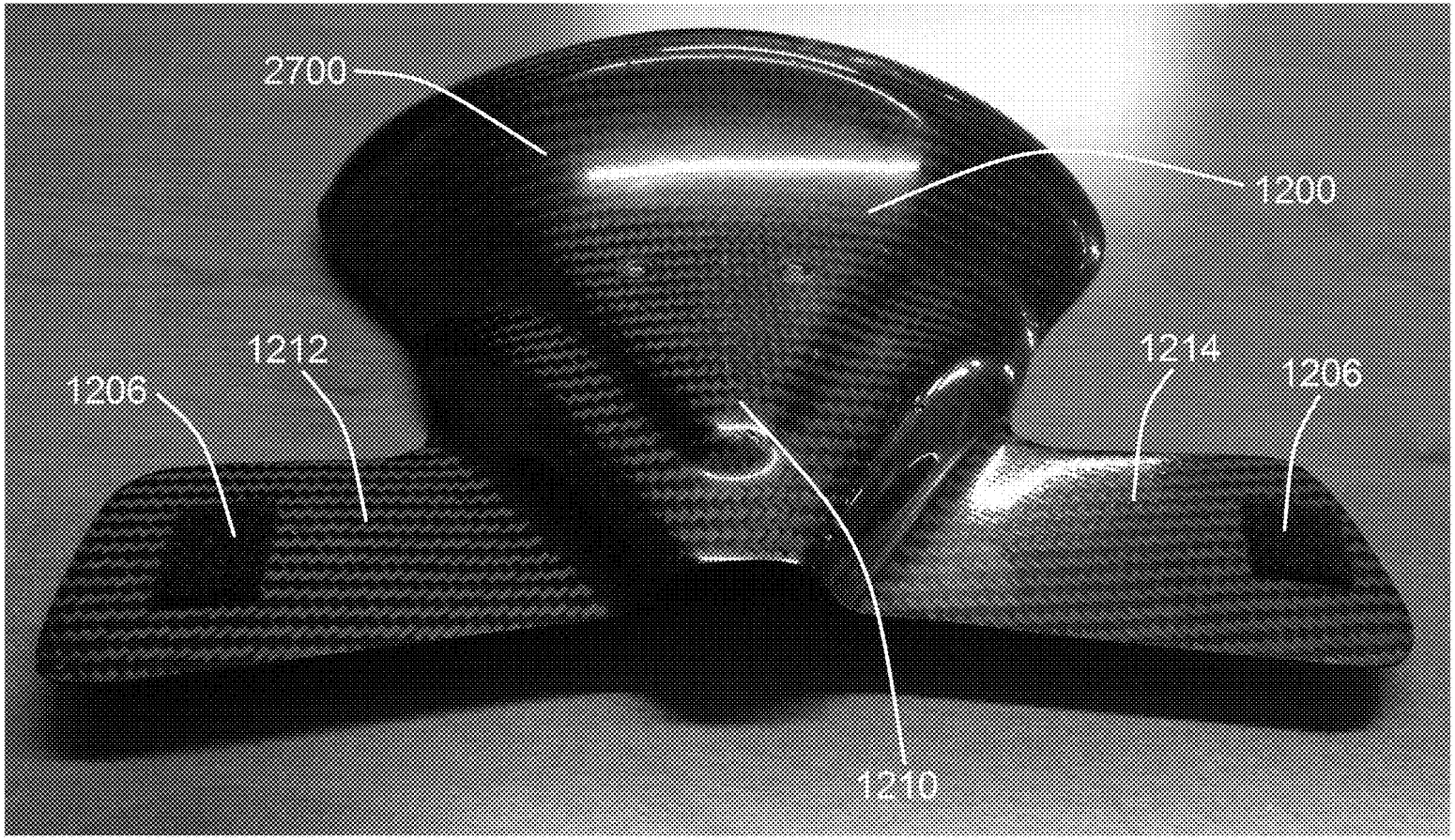
FIG. 27 shows a perspective view of an outside of a plate, according to an exemplary embodiment of the present disclosure.
Figure 28:
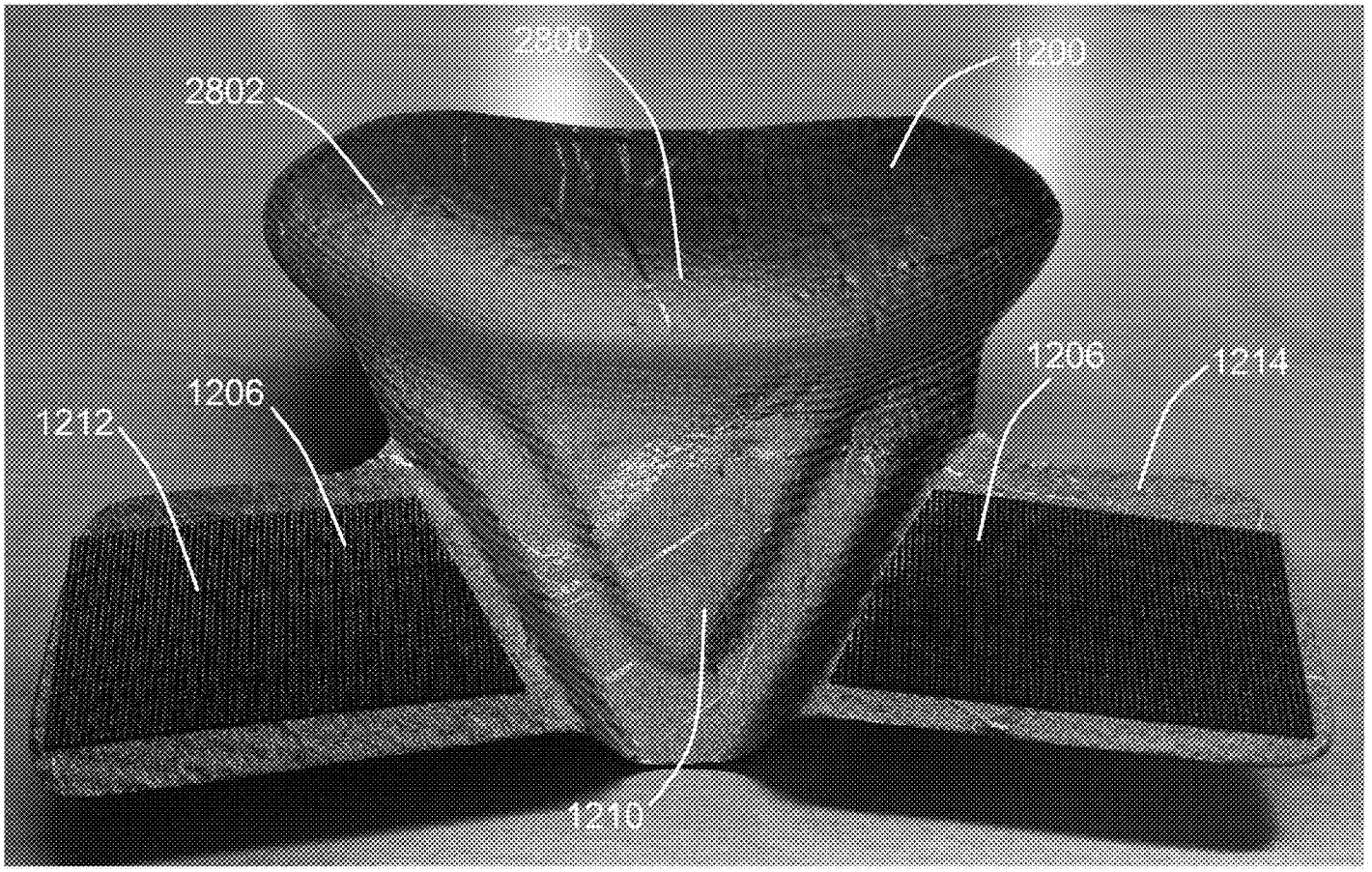
FIG. 28 shows a perspective view of an inside of a plate, according to an exemplary embodiment of the present disclosure.
Figure 29:
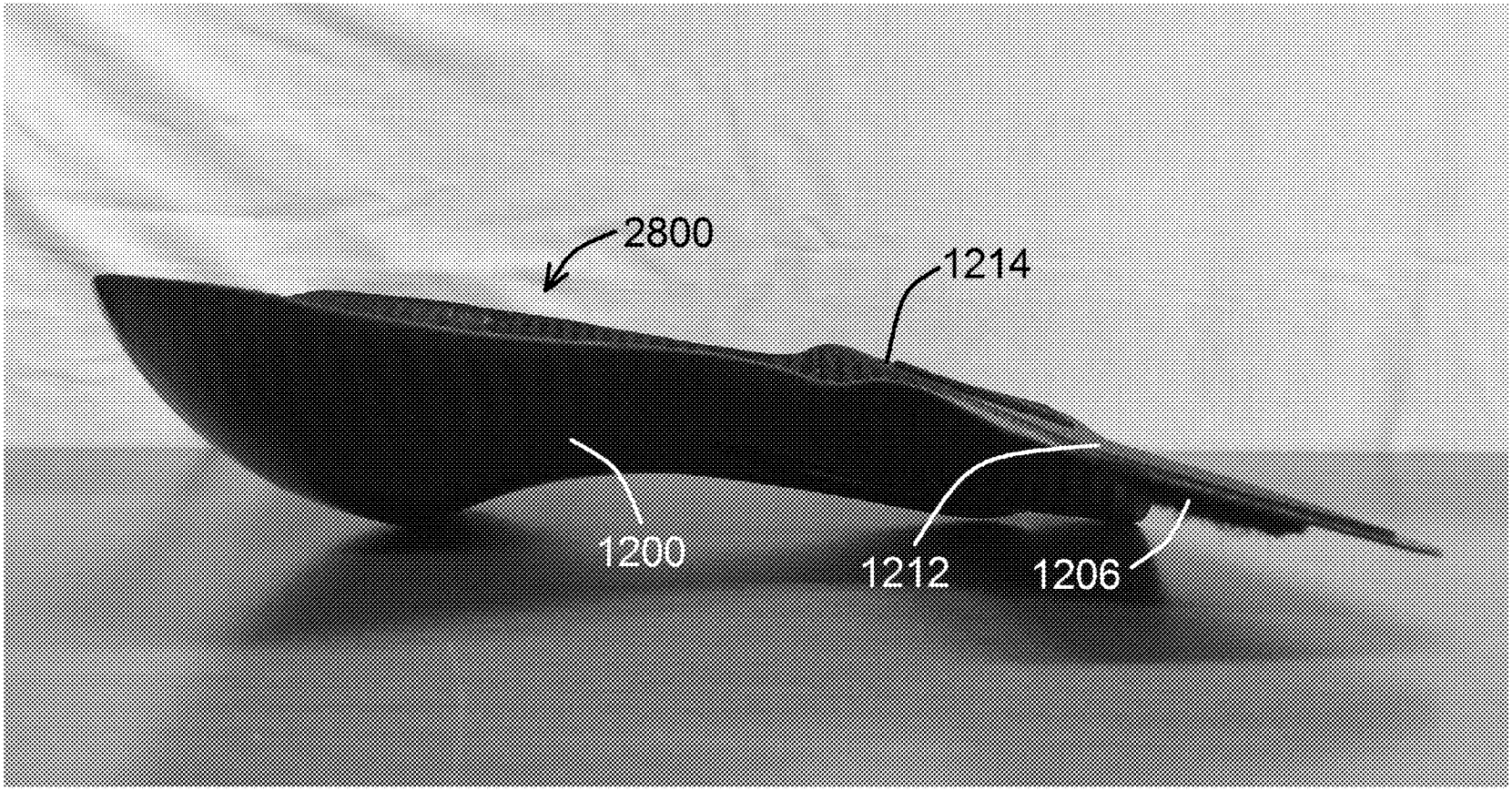
FIG. 29 shows a side view of a plate, according to an exemplary embodiment of the present disclosure.

FIGS. 27-29 show an additional exemplary embodiment of a plate 1200 of the present disclosure. As shown in FIGS. 27 and 28, plate 1200 can comprise a central portion 1210, a first side portion 1212, and a second side portion 1214. Hook and loop fastener portions 1206 can be used on one or both sides of plate 1200, such as along first side portion 1212 and/or second side portion 1214, as shown in FIGS. 27 and 28, used to mate to corresponding hook and loop fastener portions 1206 elsewhere within system 100. A relative outside surface 2700 of plate 1200 is shown in FIG. 27, while a relative inside surface 2802 of plate 1200 (showing a recessed portion 2800 therein) is shown in FIG. 28. A side view of plate 1200 is shown in FIG. 29.

Figure 30:
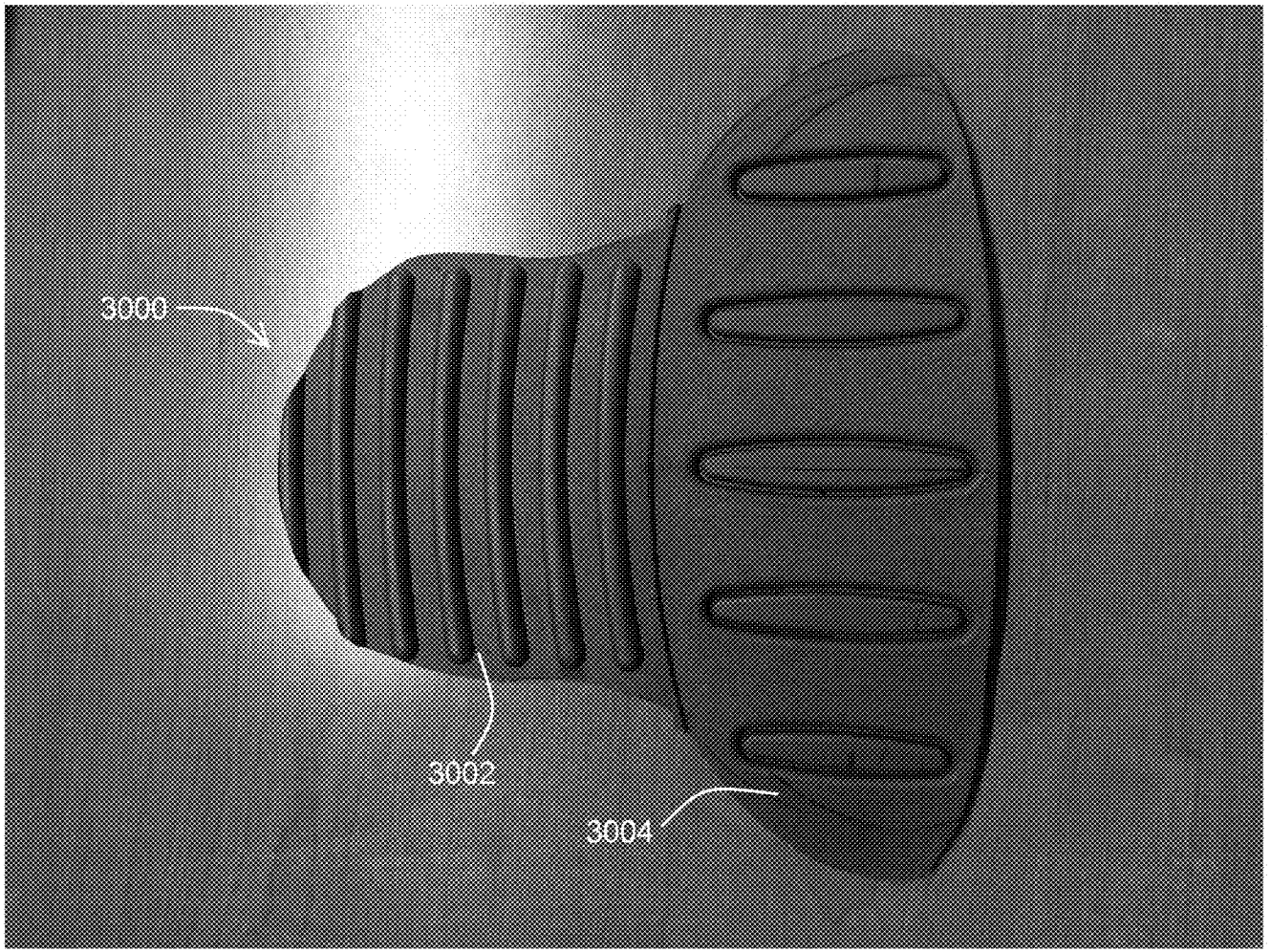
FIG. 30 shows a top view of a support, according to an exemplary embodiment of the present disclosure.
Figure 31:
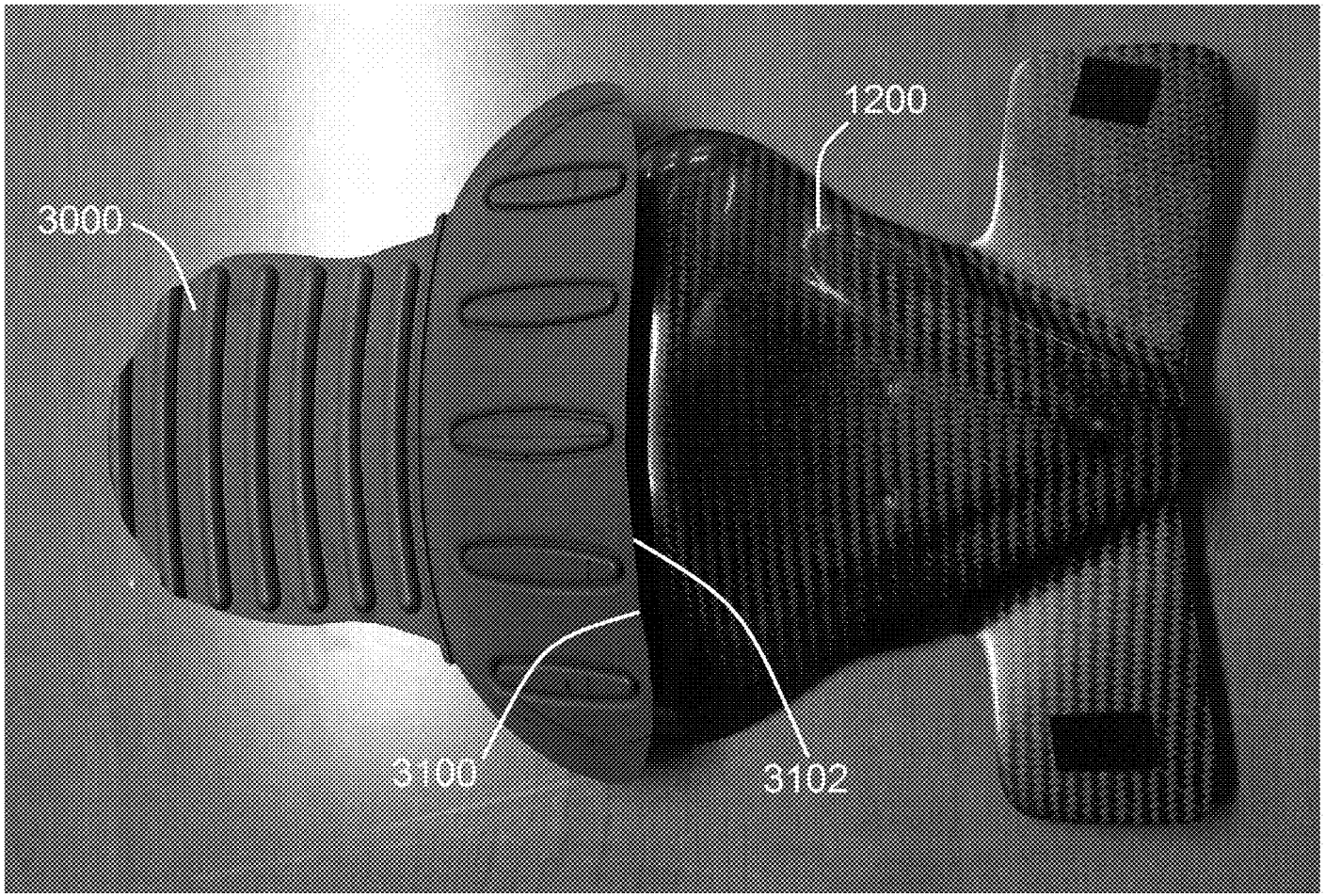
FIG. 31 shows a top view of a support with part of the support covering a plate, according to an exemplary embodiment of the present disclosure.
Figure 32:
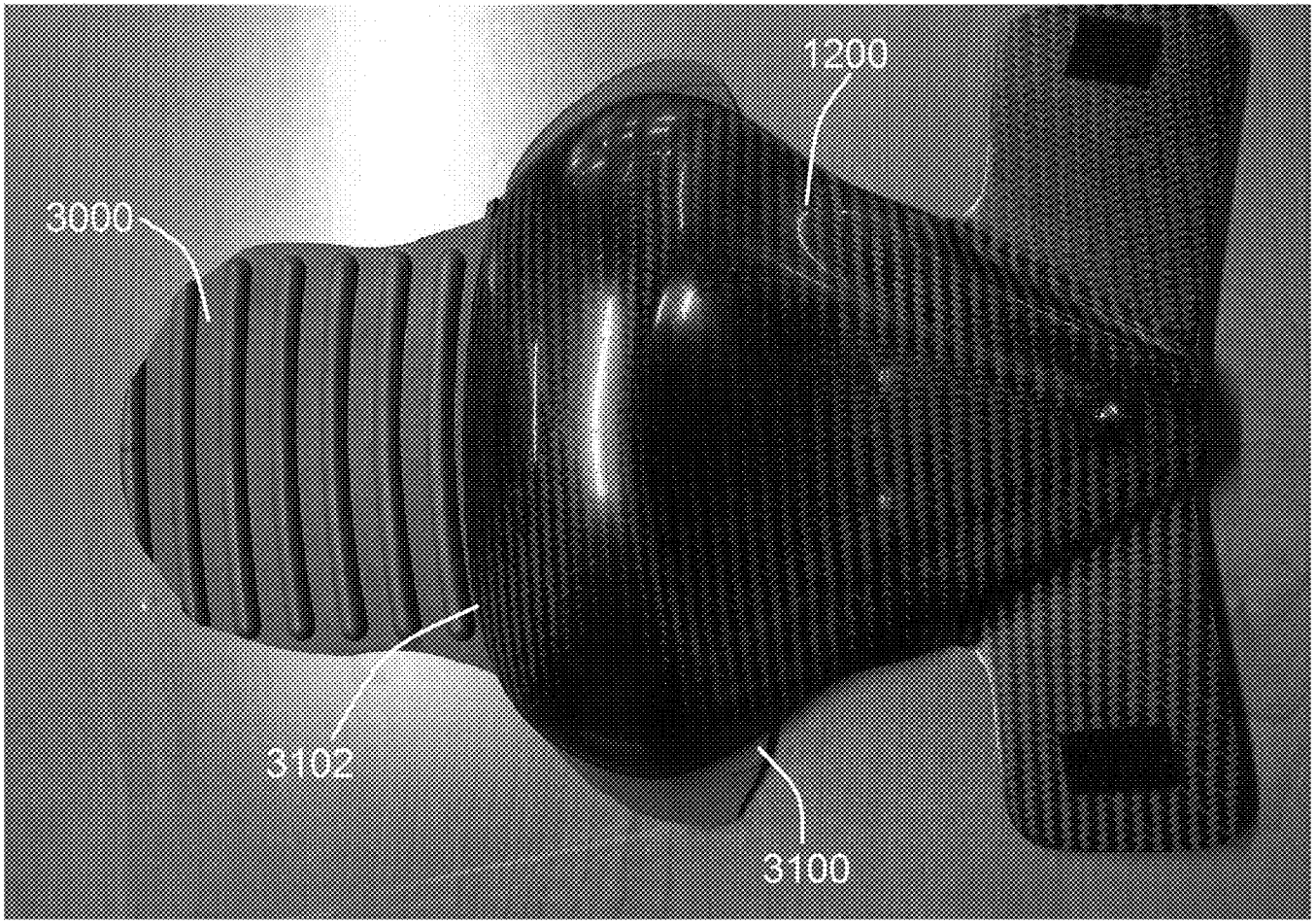
FIG. 32 shows a top view of a support with part of a plate covering the support, according to an exemplary embodiment of the present disclosure.
Figure 33:
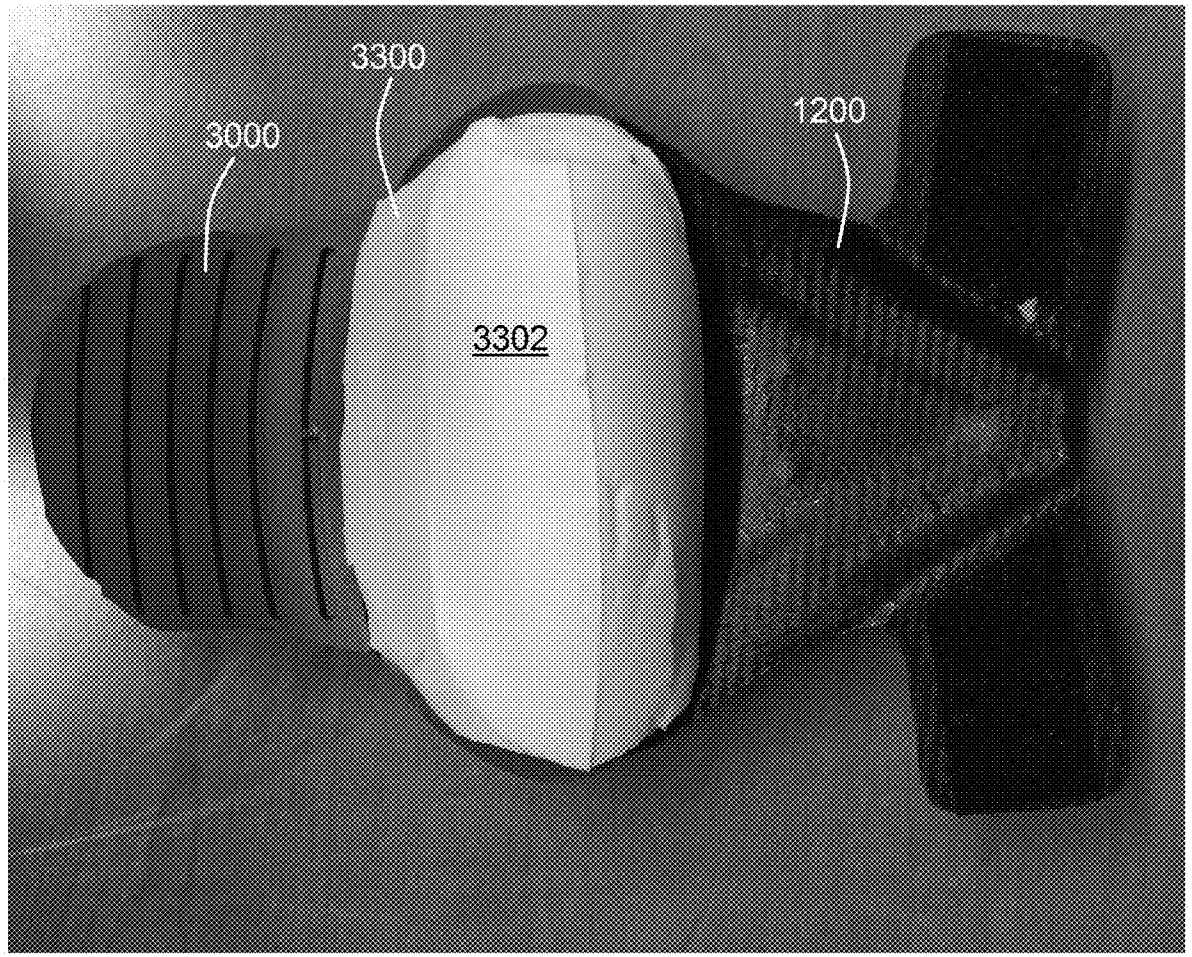
FIG. 33 shows a first cushion, a second cushion, a support, and a plate, according to an exemplary embodiment of the present disclosure.
Figure 35:
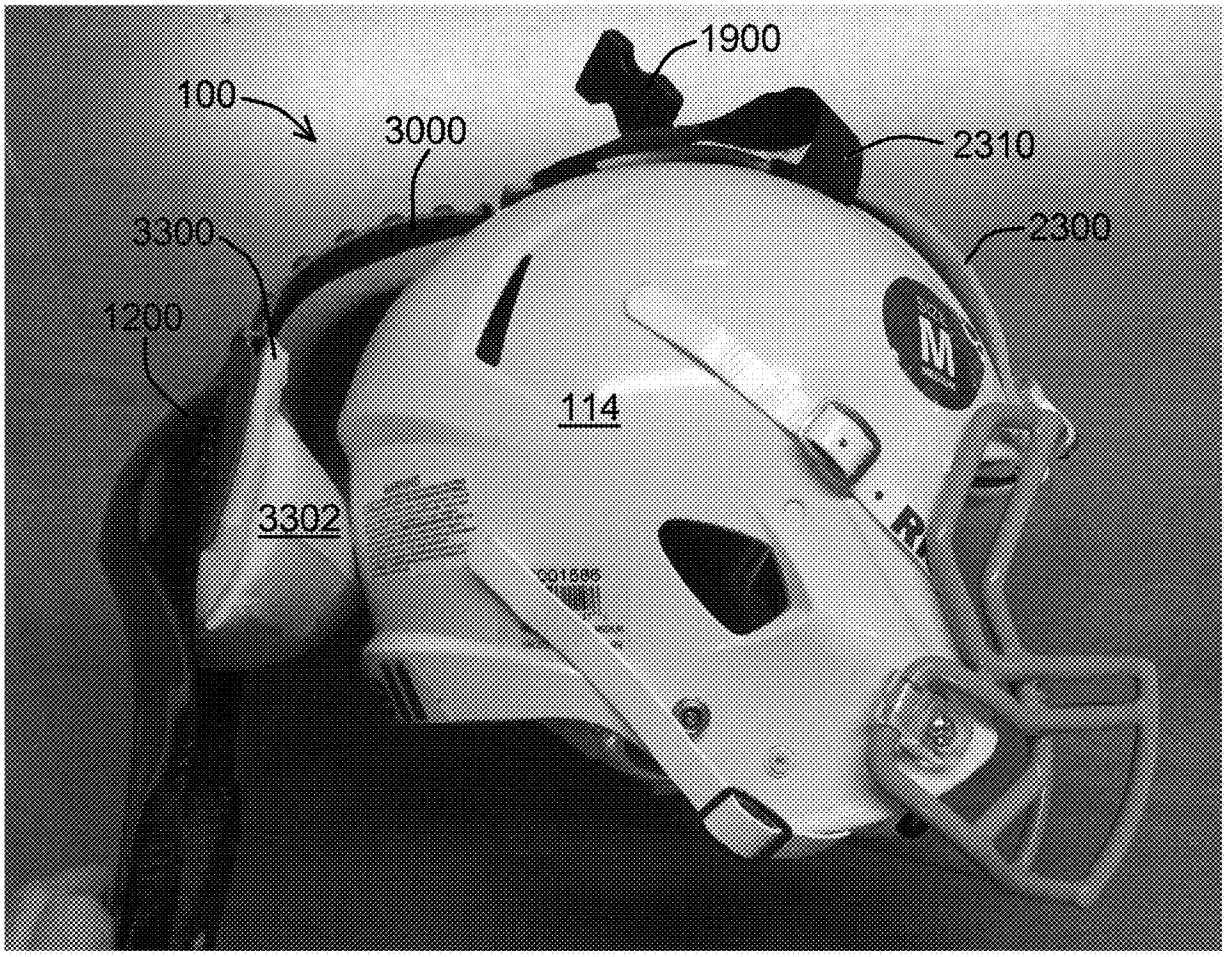
FIG. 35 shows a side view of portions of a system coupled to a headgear, according to an exemplary embodiment of the present disclosure.

An exemplary support 3000 is shown in FIGS. 30-33. As shown in FIG. 30, support 3000 can have a narrow portion 3002 and a wide portion 3004, whereby narrow portion 3002 is intended to be positioned above wide portion 3004 when system 100 is being worn. Support 3000 is intended to comprise a flexible material, such as rubber or another flexible material, so to provide a good overall fit when positioned relative to other portions of system 100. Support 3000 is shown in FIG. 31 as partially covering plate 1200 (so that lower portion 3100 of support covers upper portion 3102 of plate 1200), and is shown in FIG. 32 as being partially covered by plate 1200 (so that upper portion 3102 of plate 1200 covers lower portion 3100 of support 3000). A first cushion 3300 and a second cushion 3302 may be used in various system 100 embodiments, such as shown in FIG. 33, so to provide a cushion for headgear 114 to rest against when a relative back of headgear 114 is positioned adjacent to part of plate 1200, such as shown in FIG. 35. One or more cushions 3300, 3302 may be used in various system 100 embodiments. In at least one embodiment, first cushion 3300 comprises an impact dampening material, and second cushion 3302 comprises a traditional foam or foam rubber, such that first cushion 3302 is more readily compressible than first cushion 3300 when compressed rapidly (such as by punching the material). Cushions 3300, 3302 can couple to each other, and one or both cushions 3300, 3302 can couple to plate 1200 and/or support 3000.

Figure 34:
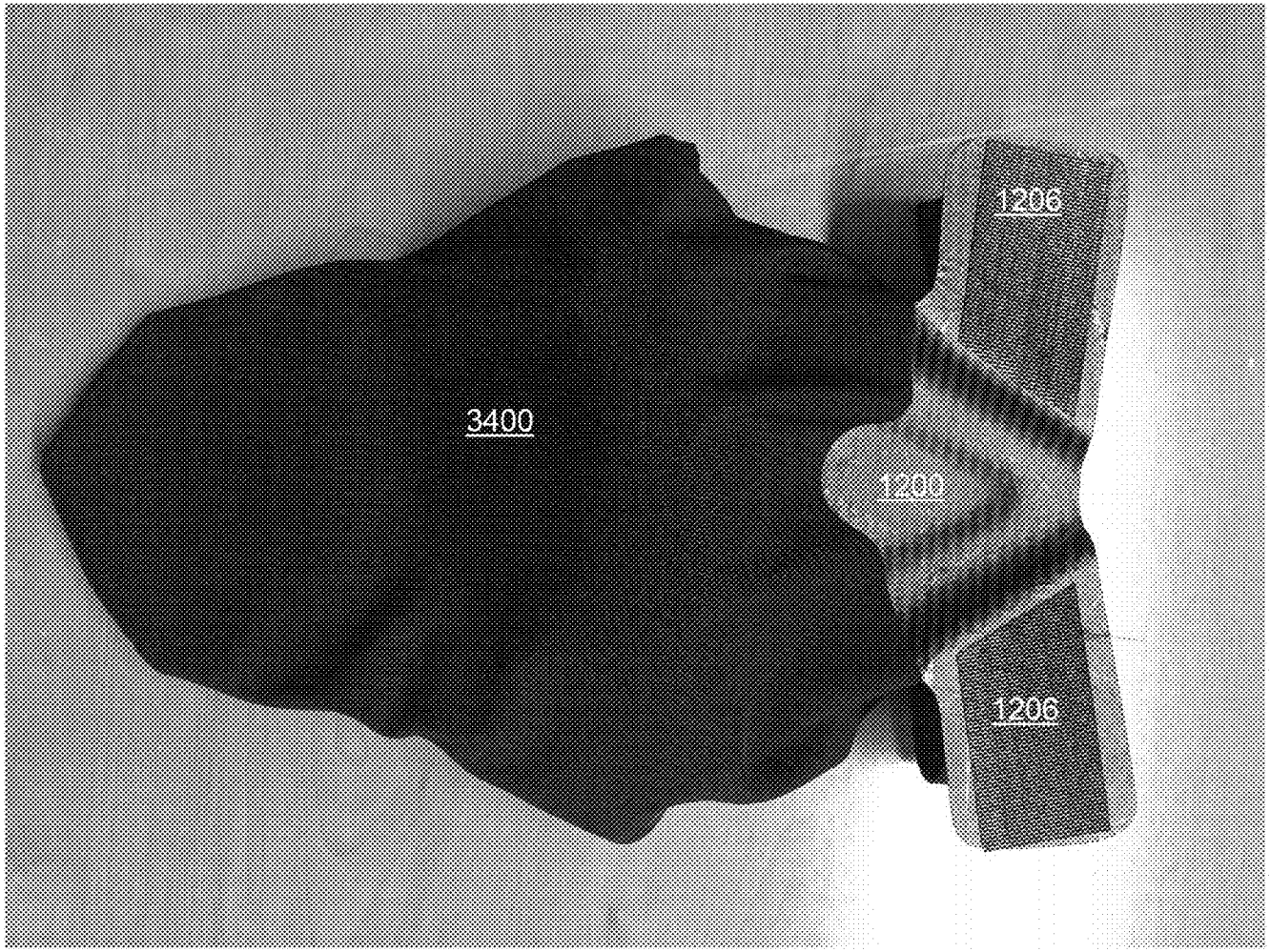
FIG. 34 shows a support cover covering part of a plate (with a support inside, not shown), according to an exemplary embodiment of the present disclosure.

FIG. 34 shows a support cover 3400 used to cover some or all of support 3000 and a portion of plate 1200, so to provide a more aesthetically pleasing look and to make it more difficult for someone else, such as an opposing player, to grab portions of system 100 when worn by a user. Support cover 3400 can also cover various apertures 1204 or other portions of system 100, as desired.

FIG. 35 shows a side view of portions of a system 100 of the present disclosure, as previously discussed and shown herein. As shown in FIG. 35, first connector strap 2300 is coupled to headgear 114, and connector 1900 can be used to connect a strap 116 (not shown) thereto. Plate 1200 is positioned on a relative back side, with one or more cushions 3300, 3302 positioned between plate 1200 and headgear 114.

Figure 36:
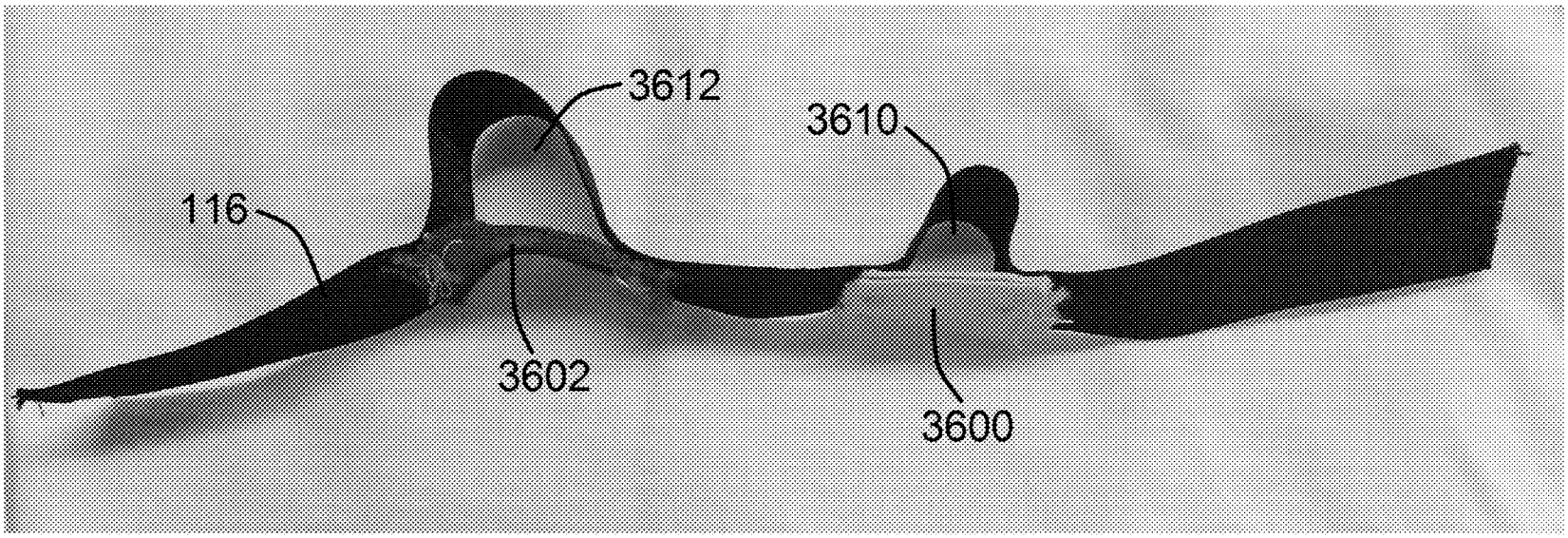
FIG. 36 shows a strap having a first and a second tensioner, according to an exemplary embodiment of the present disclosure.

FIG. 36 shows an exemplary strap 116 of the present disclosure, comprising an elastic material with what will be referred to as a first tensile strength. One or more tensioners, such as a first tensioner 3600 and/or a second tensioner 3602, can connect to strap 116 at at least two locations each, forming loops 3610, 3612 as shown in the figure. Upon pulling the relative ends of strap 116 away from one another, tensioners 3600, 3602 provide an additional tensioning effect, which may be referred to as an additional braking effect (along with strap 116), so to provide different levels of braking/deceleration. For example, and with the embodiment of strap 116 shown in FIG. 36, pulling the two ends of strap 116 away from one another will cause the non-loop portions of strap 116 to be generally straight, and further pulling will cause loop 3612 to close first, and additional pulling will cause loop 3610 to close. Such loop closure is due to the differing lengths, widths, and/or tensile strengths of tensioners 3600, 3602, relative to strap 116 and each other, for example. In at least one embodiment, strap 116 is itself not tensile, while tensioners 3600, 3602 are tensile. Straps 116, with one or more tensioners 3600, 3602 as desired, can connect to top anchor 2410 and help secure components of system 100 to one another as generally described herein. Tensioners 3600 and/or 3602 be used with straps 1202, as referenced herein, to provide an additional braking effect. For example, and from front impact, tensioners 3600, 3602 of straps 1202, along with cushions 3300, 3302, can absorb some impact/shock and further limit whiplash to the person wearing system 100.

An exemplary embodiment of strap 116, as referenced above, could be used as a vehicular seat belt, for example, such are not tensile. Upon activation of a seatbelt (such as in an abrupt slowing of a vehicle), the wearer is forced forward, while the seat belt prevents certain forward movement. That prevention is a braking that is in effect immediate, as there is no elasticity of a traditional seat belt. A seat belt comprising a strap 116 (no elasticity) and one or more tensioners 3600, 3602 would provide overall stability/integrity of the seat belt itself, while providing some gradual braking due to tensioners 3600, 3602, resulting in an improved seat belt and potential less injury to the wearer due to the seat belt itself.

Figure 37:
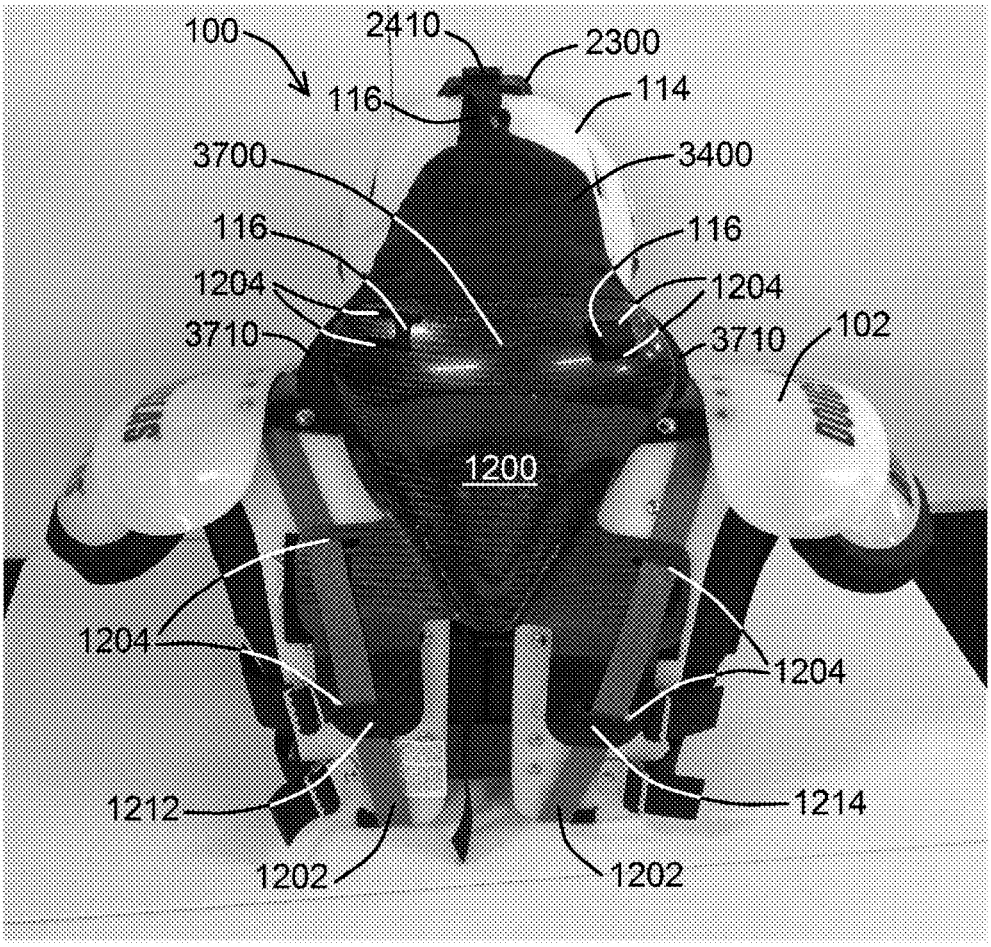
FIG. 37 shows a back view of portions of a system coupled to a headgear and a shoulder apparatus, according to an exemplary embodiment of the present disclosure.

FIG. 37 shows a back view of portions of an exemplary system 100 of the present disclosure. As shown therein, a headgear 114 is effectively coupled to a shoulder apparatus 102 by way of a front anchor strap 2300, a strap 116, a support 3000 (within support cover 3400), a plate 1200, and straps 1202. Straps 1202 can connect under shoulder portions of shoulder apparatus 102 and on the inside of shoulder apparatus 102 at a relative bottom, such as shown in FIG. 37 and previously described herein, using hook and loop fastener portions 1206 or other fasteners, allowing for the system 100 to be effectively tightened. Straps 1202 can pass through apertures 1204 of plate 1200, whereby plate 1200 is shown in FIG. 37 as having a relatively longer first side portions 1212 and second side portion 1214 as shown in other embodiments previously referenced herein. More hook and loop fastener portions 1206 (longer, wider, etc.) can then be used on plate 1200 to secure plate 1200 to a relative back of shoulder apparatus 102 having hook and loop fastener portions 1206 affixed thereto. A larger distance between apertures 1204 on each side of plate 1200 provides for additional stability of plate 1200 against a back part of shoulder apparatus 102, such that if a headgear 114 is moved backwards against plate 1200, plate 1200 is less susceptible to movement away from a back portion of shoulder apparatus 102. Straps 116 can also pass through apertures 1204 of plate 1200, as shown in FIG. 37 so to secure straps 116 to plate 1200 so that headgear 114 is ultimately connected to plate 1200 by way of front anchor strap 2300 being coupled to headgear 114, top anchor 2410 being coupled to front anchor strap 2300, and strap 116 being coupled to front anchor strap 2300.

Support cover 3400, as shown in FIG. 37, prevents a user from grabbing portions of system 100 during game play. Cushioned wings 3710, as shown in FIG. 37, can extend laterally beyond plate 1200, so that if someone attempts to grab that part of system 100 from behind, cushioned wings 3710 prevent a good grip and cause the hands to slip away from system 100.

Figure 38:
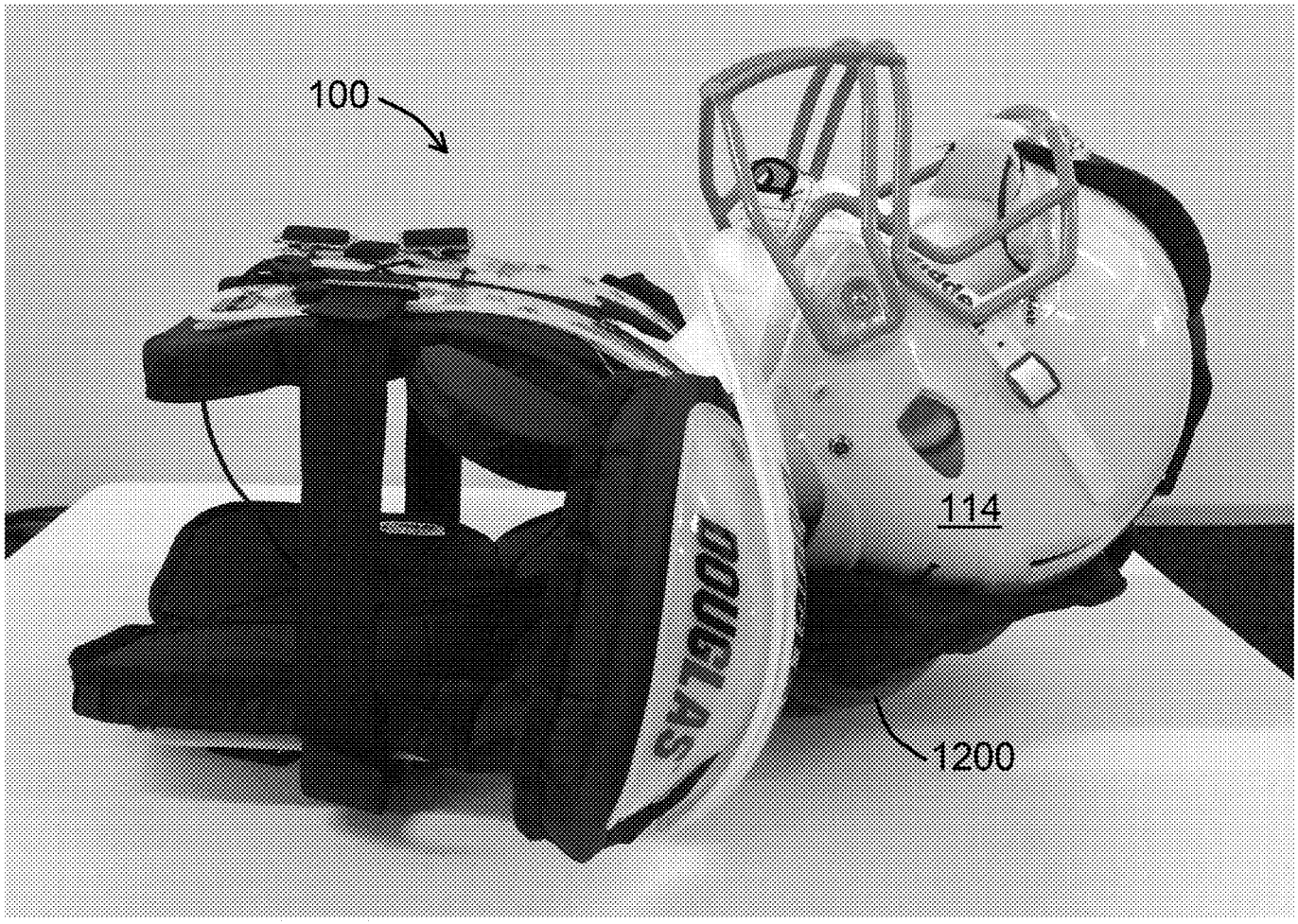
FIG. 38 shows a side view of portions of a system coupled to a headgear and a shoulder apparatus, according to an exemplary embodiment of the present disclosure.

FIG. 38 shows a side view of portions of an exemplary system 100. It is noted that when a wearer is laying on his or her back, such as in the position shown in FIG. 38, headgear 114 is effectively stabilized off of the ground, providing good spinal alignment, and allowing the player to rest with a stable head and potentially be treated as needed.

Figure 39:
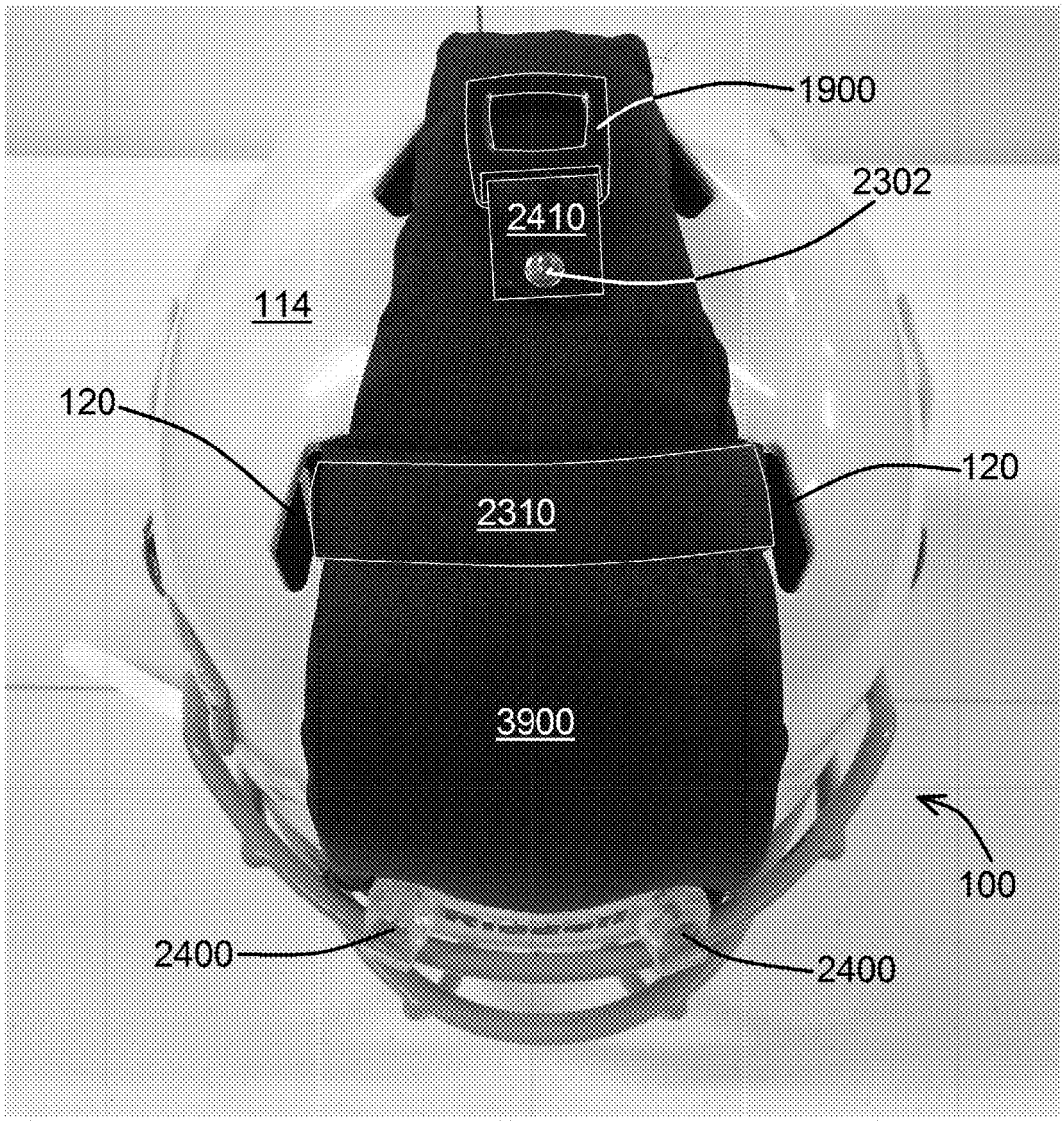
FIG. 39 shows a top perspective view of a headgear, according to an exemplary embodiment of the present disclosure.

FIG. 39 shows portions of a system 100, whereby front anchor strap 2300 is covered using an anchor cover 3900. Other elements as shown therein are as previously described herein.

Figure 40:
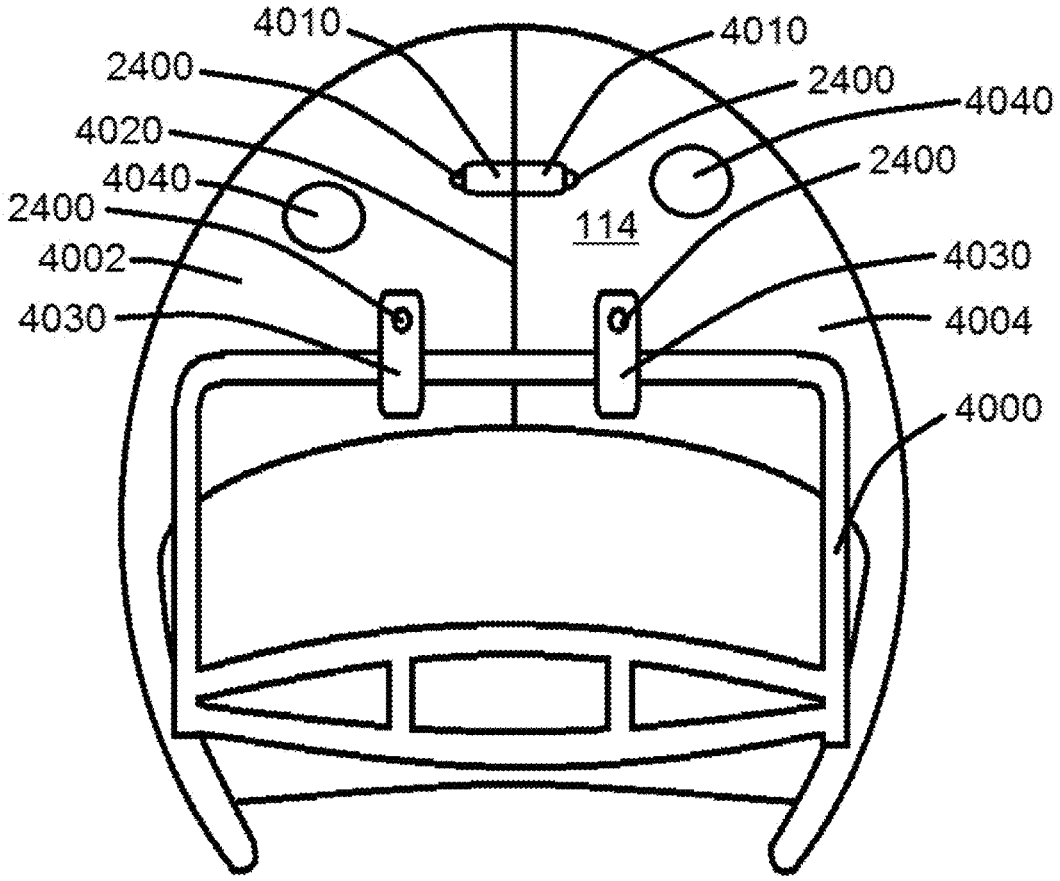
FIG. 40 shows a front view of a headgear, according to an exemplary embodiment of the present disclosure.

FIG. 40 shows an exemplary headgear 114 of the present disclosure for use as part of or in connection with a system 100 of the present disclosure. As shown therein, headgear 114 has at least one seam 4020, such that headgear 114 is actually formed as two (or more) pieces 4002, 4004 (for example) connected to one another using, for example, one or more couplers 4030 coupled to headgear 114 and/or one or more fasteners 2400 positioned within couplers 4030. Couplers 4030 are intended to solely, or in connection with one or more fasteners 2400, connect parts (such as halves) of headgear 114 to one another. Fasteners 2400 (such as within anchors 4010) can also be used to connect separate portions of headgear 114 to one another. Such a headgear 114 embodiment is useful when, for example, a player is injured or has a suspected neck injury, and whereby pulling the headgear 114 off the player's head may cause further injury. In such a headgear embodiment, fasteners 2400 and/or couplers 4300 can be released so to allow for easy removal of headgear 114 without pulling on the player's head or neck.

FIG. 40 also shows adhesive cushions 4040 coupled to headgear 114. Adhesive cushions 4040 of the present disclosure comprise a cushioning material (foam, foam rubber, rubber, etc.) that uses an adhesive to stick to headgear 114, providing additional headgear 114 cushion.

Figure 41:
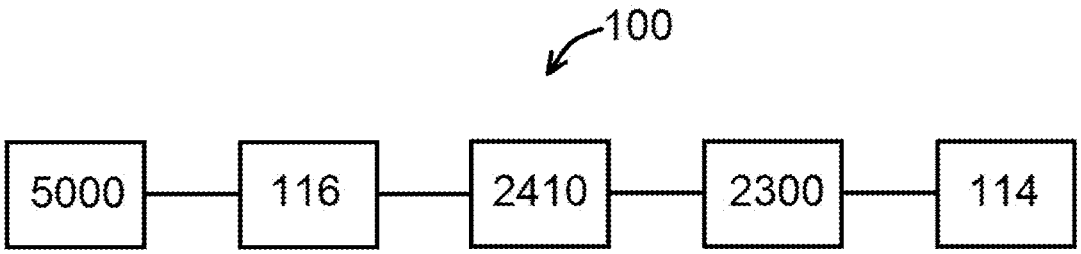
FIG. 41 shows a block diagram of components of a system connected to a substrate, according to an exemplary embodiment of the present disclosure.

FIG. 41 shows a block component diagram of components of an exemplary system 100 of the present disclosure used to ultimately connect a headgear 114 to a substrate 5000, such as a racecar, a racecar seat, and/or the like or another substrate 5000. For example, and as shown therein, anchor strap 2300 can be coupled to headgear 114, top anchor 2410 can be coupled to front anchor strap 2300, one or more straps 116 can be coupled to top anchor 2410 (or a connector 1900 of top anchor 2410), and the one or more straps 116 can be connected to substrate 5000, such as a racecar, a racecar seat, and/or the like or another substrate 5000. Such a system 100 embodiment could help reduce instances of whiplash, and potentially concussions, by providing dynamic braking as referenced herein, such as via one or more straps 116, versus no dynamic braking, such as when a racecar driver's helmet (an exemplary headgear 114) is connected to a racecar without such a tensile strap 116.

If a user wears an exemplary system 100 embodiment and looks downward, such as attempting to use the headgear 114 as a weapon to spear an opponent, tensile strap 116 would prevent such movement, but would allow for some, but less than normal, downward view as compared to a user not wearing system 100. Strap 116 would slow the forward movement of headgear 114, and then the braking effect would pull headgear 114 back to a safe position, reducing whiplash such as if the player were hit from behind. Systems 100 of the present disclosure allow for uninhibited side to side (rotational) headgear 114 movement relative to shoulder apparatus 102.

If a wearer of system 100 is hit from the front, a strap cushion 2420 can absorb some impact, cushions 3300, 3302 can absorb some impact, adhesive cushions 4040 can absorb some impact, and plate 1200 prevents headgear 114 from moving too far backwards, protecting the player's neck and head.

Various elements referenced herein, such as front anchor strap 2300 and other elements of the present disclosure, can be built into an exemplary headgear 114.

While various embodiments of whiplash reduction devices and systems and methods of using the same have been described in considerable detail herein, the embodiments are merely offered as non-limiting examples of the disclosure described herein. It will therefore be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

The invention claimed is:

1. A system, comprising:

a front anchor strap coupled directly or indirectly to a headgear;

a top anchor coupled to the front anchor strap, the top anchor having a connector coupled thereto, the connector configured to connect to at least one rear strap;

a first retainer configured to fit within apertures defined within the headgear and to wrap around at least part of the headgear and at least part of the front anchor strap to secure the front anchor strap to the headgear at or near the apertures;

a plate having a central portion defining a recessed portion and further having a first side portion and a second side portion; and wherein the at least one rear strap has a first tensile strength, and wherein the at least one rear strap further comprises at least one tensioner coupled thereto so to form a loop;

wherein the at least one tensioner has a second tensile strength, and whereby first pulling relative ends of the at least one rear strap away from one another causes portions of the at least one rear strap not forming the loop to be relatively straight, and whereby additional pulling the relative ends of the at least one rear strap away from one another causes portions of the at least one rear strap forming the loop to be relatively straight so to close the loop.

2. The system of claim 1, wherein the front anchor strap is coupled directly to the headgear using one or more fasteners.

3. The system of claim 1, wherein the front anchor strap is coupled indirectly to the headgear by coupling the front anchor strap to a plate and coupling the plate to the headgear.

4. The system of claim 1, further comprising:

a connector positioned upon or within the front anchor strap, the connector configured to couple the front anchor strap to the top anchor and to allow the top anchor to pivot relative to the connector.

5. The system of claim 1, further comprising:

a strap cushion coupled to the front anchor strap.

6. The system of claim 1, further comprising:

a second retainer configured to fit within additional apertures defined within the headgear and to wrap around at least part of the headgear and at least part of the front anchor strap to secure the front anchor strap to the headgear at or near the additional apertures.

7. The system of claim 1, further comprising:

a support comprising a flexible material, the support configured to at least partially cover the central portion of the plate.

8. The system of claim 7, further comprising:

a support cover configured to cover at least part of the support.

9. The system of claim 1, further comprising:

a first cushion positioned within the recessed portion of the plate.

10. The system of claim 9, further comprising:

a second cushion positioned adjacent to the first cushion, wherein the first cushion comprises an impact dampening material, and wherein the second cushion comprises foam or foam rubber.

11. The system of claim 1, wherein when the headgear is worn by a person who is also wearing a shoulder apparatus, the system adapted to be connected to the shoulder apparatus using a first shoulder strap and a second shoulder strap, the first and second shoulder straps configured to connect to the shoulder apparatus and to connect to the plate.

12. The system of claim 11, wherein the first shoulder strap and the second shoulder strap have a hook and loop fastener portion corresponding to hook and loop fastener portions of the shoulder apparatus and the plate, whereby the hook and loop fastener portions of the first shoulder strap and the second shoulder strap are configured to the hook and loop fastener portions of the shoulder apparatus and the plate.

13. The system of claim 9, wherein when the headgear is worn by a person who is also wearing a shoulder apparatus, the first cushion is positioned adjacent to a rear portion of the headgear.

14. The system of claim 11, wherein when the headgear is worn by a person who is also wearing a shoulder apparatus, the person can rotate his or her head relative to a pivot point located at or near a relative top of the headgear where the top anchor is coupled to the front anchor strap.

15. The system of claim 1, wherein when the headgear is worn by a person who is also wearing a shoulder apparatus and upon impact to the headgear, the at least one rear strap would slow movement of the headgear in a first direction, and a braking effect caused by the at least one rear strap would cause the headgear to move in an opposite second direction so to reduce or prevent whiplash.

16. A system, comprising:

a front anchor strap coupled directly or indirectly to a headgear;

a top anchor coupled to the front anchor strap, the top anchor having a connector coupled thereto, the connector configured to connect to at least one rear strap;

a first retainer configured to fit within apertures defined within the headgear and to wrap around at least part of the headgear and at least part of the front anchor strap to secure the front anchor strap to the headgear at or near the apertures;

a plate having a central portion defining a recessed portion and further having a first side portion and a second side portion;

a support comprising a flexible material, the support configured to at least partially cover the central portion of the plate;

a first cushion positioned within the recessed portion of the plate; and wherein when the headgear is worn by a person who is also wearing a shoulder apparatus, the system adapted to be connected to the shoulder apparatus using a first shoulder strap and a second shoulder strap, the first and second shoulder straps configured to connect to the shoulder apparatus and to connect to the plate;

wherein the at least one rear strap has a first tensile strength, and wherein the at least one rear strap further comprises at least one tensioner coupled thereto so to form a loop;

wherein the at least one tensioner has a second tensile strength, and whereby first pulling relative ends of the at least one rear strap away from one another causes portions of the at least one rear strap not forming the loop to be relatively straight, and whereby additional pulling the relative ends of the at least one rear strap away from one another causes portions of the at least one rear strap forming the loop to be relatively straight so to close the loop.

17. The system of claim 16, further comprising the headgear, wherein the headgear comprises a first piece and a second piece configured to be held together using one or more fasteners or anchors and further configured to be removed from the person wearing the headgear by disengaging the fasteners or anchors to separate the first piece from the second piece.

18. A method of reducing or preventing instances of whiplash, comprising the step of:

wearing a system, the system comprising:

a front anchor strap coupled directly or indirectly to a headgear;

a top anchor coupled to the front anchor strap, the top anchor having a connector coupled thereto, the connector configured to connect to at least one rear strap;

a first retainer configured to fit within apertures defined within the headgear and to wrap around at least part of the headgear and at least part of the front anchor strap to secure the front anchor strap to the headgear at or near the apertures;

a plate having a central portion defining a recessed portion and further having a first side portion and a second side portion;

a support comprising a flexible material, the support configured to at least partially cover the central portion of the plate, and a first cushion positioned within the recessed portion of the plate; and wherein when the headgear is worn by a person who is also wearing a shoulder apparatus, the system can be connected to the shoulder apparatus using a first shoulder strap and a second shoulder strap, the first and second shoulder straps configured to connect to the shoulder apparatus and to connect to the plate;

wherein the at least one rear strap has a first tensile strength, and wherein the at least one rear strap further comprises at least one tensioner coupled thereto so to form a loop;

wherein the at least one tensioner has a second tensile strength, and whereby first pulling relative ends of the at least one rear strap away from one another causes portions of the at least one rear strap not forming the loop to be relatively straight, and whereby additional pulling the relative ends of the at least one rear strap away from one another causes portions of the at least one rear strap forming the loop to be relatively straight so to close the loop.

* * * * *